US007542692B2

(12) United States Patent
Yamamoto et al.

(10) Patent No.: US 7,542,692 B2
(45) Date of Patent: Jun. 2, 2009

(54) IMAGE FORMING APPARATUS WITH DETECTING MEMBERS FOR DETERMINING WHEN SET WIDTH IS WRONG

(75) Inventors: Yuichi Yamamoto, Abiko (JP); Kuniyasu Kimura, Toride (JP); Takahiko Yamaoka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 109 days.

(21) Appl. No.: 11/470,822

(22) Filed: Sep. 7, 2006

(65) Prior Publication Data

US 2007/0059002 A1 Mar. 15, 2007

(30) Foreign Application Priority Data

Sep. 13, 2005 (JP) ..... 2005-265878

(51) Int. Cl.
*G03G 15/20* (2006.01)

(52) U.S. Cl. ..... 399/69; 399/33; 399/45; 399/92; 219/216

(58) Field of Classification Search ..... 399/33, 399/69, 45, 92; 219/216
See application file for complete search history.

(56) References Cited

U.S. PATENT DOCUMENTS 4,963,943 A * 10/1990 Tamary ..... 399/335
5,148,226 A 9/1992 Setoriyama et al. ..... 355/290
5,210,579 A 5/1993 Setoriyama et al. ..... 355/285
5,525,775 A 6/1996 Setoriyama et al. ..... 219/216
5,530,556 A * 6/1996 Miura et al. ..... 358/300
5,550,621 A * 8/1996 Ogawahara ..... 399/69
5,787,321 A * 7/1998 Nishikawa et al. ..... 399/69
6,532,348 B2 * 3/2003 Allmendinger ..... 399/69
6,539,185 B2 * 3/2003 Hanyu et al. ..... 399/67
6,801,729 B2 * 10/2004 Wada et al. ..... 399/68
2001/0017992 A1 * 8/2001 Hayashi et al. ..... 399/68
2004/0052542 A1 * 3/2004 Kinoshita ..... 399/69
2004/0190925 A1 * 9/2004 Baruch et al. ..... 399/69
2006/0062610 A1 * 3/2006 Ito et al. ..... 399/328
2006/0227205 A1 10/2006 Nishihara et al. ..... 347/194

(Continued)

FOREIGN PATENT DOCUMENTS

JP 60-136779 7/1985

(Continued)

*Primary Examiner*—David M Gray
*Assistant Examiner*—G. M. Hyder
(74) *Attorney, Agent, or Firm*—Fitzpatrick, Cella, Harper & Scinto

(57) ABSTRACT

An image forming system has an image forming device for forming an image on a recording material in accordance with a set width of the recording material, and an image heating member. A first detecting member which detects a temperature of a first region of the image heating member, the first region corresponding to an outside region of a contact area, the contact area being contactable with a recording material having the set width, a second detecting member which detects a temperature of a second region of the image heating member, the second region corresponding to an inside region of the contact area, a cooling portion cools the first region of the image heating member in accordance with an output of the first detecting member, and a notification portion notifies that the set width of the recording material is wrong in accordance with an output of the first detecting member and an output of the second detecting member.

3 Claims, 15 Drawing Sheets

U.S. PATENT DOCUMENTS

| | | | | |
|---|---|---|---|---|
| 2007/0140717 | A1 | 6/2007 | Hayashi et al. | 399/69 |
| 2007/0147865 | A1 | 6/2007 | Hanada et al. | 399/67 |

FOREIGN PATENT DOCUMENTS

| | | |
|---|---|---|
| JP | 4-44075 | 2/1992 |
| JP | 4-44076 | 2/1992 |
| JP | 4-44077 | 2/1992 |
| JP | 4-44078 | 2/1992 |
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 5-181382 | 7/1993 |
| JP | 2003-76209 | 3/2003 |

* cited by examiner

| FAN CONTROL | TH1 | TH2 | |
|---|---|---|---|
| OFF | ○ | ○ | ⇒ LARGE SIZE NORMAL |
| OFF | × | ○ | ⇒ SET SIZE ABNORMAL |
| ON | ○ | ○ | ⇒ FAN CONTROL NORMAL |
| ON | × | ○ | ⇒ FAN CONTROL ABNORMAL |
| ON | ○ | × | ⇒ SET SIZE ABNORMAL |

○:THERMISTOR NORMAL TEMPERATURE DETECTION
×:THERMISTOR ABNORMAL TEMPERATURE DETECTION

| FIG. 3A | FIG. 3B |
|---|---|

IMAGE FORMING APPARATUS WITH DETECTING MEMBERS FOR DETERMINING WHEN SET WIDTH IS WRONG

BACKGROUND OF THE INVENTION

1. Field of the Invention

The present invention relates to an image forming apparatus which forms an image on a recording material, more particularly to an image forming apparatus such as a photocopier, a printer, a facsimile machine or a multi-functional apparatus including some of these functions.

2. Description of the Related Art

Heretofore, as a fixing system to fix an unfixed toner image onto a recording material, owing to safety and satisfactory fixing property, a thermal fixing system is generally used in which the unfixed toner image is heated, melted and fixed to the recording material.

Especially, owing to a satisfactory thermal efficiency and ease of miniaturizing, a thermal roller system is broadly used in which the unfixed toner image on the recording material is heated, pressurized and thermally fixed in a fixing region where a heat roller (roll) is brought into contact under pressure with a pressure roller.

In a fixing apparatus of the thermal roller system, there are used a fixing roller including a heater therein, and the pressure roller brought into contact under pressure with this fixing roller to face the fixing roller, and the recording material is introduced into a fixing nip portion between this pair of rollers to pass through the portion. Accordingly, the unfixed toner image formed and borne on the surface of the recording material is fixed onto the surface of the recording material by heat and pressure.

In recent years, from viewpoints of quick starting and energy saving, a fixing apparatus of a film (belt) heating system has been put to practical use.

In the fixing apparatus of the film heating system, a heat-resisting film (hereinafter referred to as the fixing film) is sandwiched between a ceramic heater as a heating member and the pressure roller as a pressurizing member to form the fixing nip portion. Moreover, the recording material on which the unfixed toner image is formed and borne is introduced between the fixing film of the fixing nip portion and the pressure roller, and sandwiched and conveyed together with the fixing film. Accordingly, while applying heat of the ceramic heater via the fixing film, the unfixed toner image is fixed onto the surface of the recording material by a pressurizing force of the fixing nip portion.

In the fixing apparatus of the thermal roller system or the film heating system described above, there is known a problem that a temperature of a non-sheet-passing portion rises during continuous passing of the recording material having a width which is smaller than that of the recording material having the maximum sheet passing width.

When the recording material having the maximum size is passed to fix the image, the surface of the heat roller has an approximately uniform temperature distribution over the whole length of the fixing region. However, in a case where the recording material having a small size is continuously passed to fix the image, the temperature of the surface of a non-sheet-passing region of the heat roller excessively rises. This is because when the recording material having the small size is continuously passed, in the non-sheet-passing region where any recording material does not pass, any heat is not taken by the recording material and the heat is partially accumulated.

To solve the problem, as disclosed in Japanese Patent Application Laid-Open Nos. S60-136779, H05-181382 and 2003-076209, there is proposed a constitution in which a temperature sensor is disposed to detect the temperature of a region of the heat roller as the non-sheet-passing portion during the fixing onto the small-sized recording material. In a case where the temperature detected by this temperature sensor rises at a predetermined temperature, the corresponding region of the heat roller is cooled by a fan.

In a case where the width of the recording material set by a user is larger than that of an actual recording material, however, even when the temperature detected by the temperature sensor is normal owing to a cooling effect of the fan, the temperature of a part of the region which must be a sheet passing portion of the heat roller might excessively rise. On the other hand, in a case where the width of the recording material set by the user is smaller than that of the actual recording material, a fixing defect might be generated in an end portion of the recording material in a width direction owing to the cooling effect of the fan.

SUMMARY OF THE INVENTION

An object of the present invention is to provide an image forming apparatus which can appropriately cope with even a case where a set width of a recording material is different from an actual width.

Another object of the present invention is to provide an image forming apparatus including image forming means for forming an image on a recording material; an image heating member which heats the image on the recording material at a nip portion, first detecting means for detecting a temperature of a first region outside a region, which can be brought into contact with the recording material, of the image heating member in a width direction, when a set width of the recording material is a predetermined width, cooling means for cooling the first region of the image heating member in accordance with output of said first detecting means, second detecting means for detecting a temperature of a second region at an end side in the width direction within the region, which can be brought into contact with the recording material, of said image heating member, when the set width of the recording material is the predetermined width; and notification means for notifying that the set width of the recording material is wrong in accordance with the output of the first detecting means and the output of the second detecting means.

A further object of the present invention is to provide an image forming apparatus including image forming means for forming an image on a recording material, an image heating member which heats the image on the recording material at a nip portion, first detecting means for detecting a temperature of a first region outside a region, which can be brought into contact with the recording material, of the image heating member in a width direction, when a set width of the recording material is a predetermined width, cooling means for cooling the first region of the image heating member in accordance with the output of the first detecting means, second detecting means for detecting a temperature of a second region at an end side in the width direction within the region, which is enabled to bring into contact with the recording material, of said image heating member, when the set width of the recording material is the predetermined width, and means for decreasing the number of the recording materials which pass through the nip portion per unit time in accordance with the output of the first detecting means and the output of the second detecting means.

A further object of the present invention is to provide an image forming apparatus including image forming means for forming an image on a recording material in accordance with a set width of the recording material, an image heating member which heats the image on the recording material at a nip portion; first detecting means for detecting a temperature of a first region outside a region, which can be brought into contact with the recording material, of the image heating member in a width direction, when a set width of the recording material is a predetermined width; cooling means for cooling the first region of the image heating member in accordance with the output of the first detecting means; second detecting means for detecting a temperature of a second region at an end side in the width direction within the region, which can be brought into contact with the recording material, of said image heating member, when the set width of the recording material is the predetermined width; and means for discontinuing the image forming process in accordance with the output of the first detecting means and the output of the second detecting means.

A further object of the present invention is to provide an image forming apparatus including image forming means for forming an image on a recording material in accordance with a set width of the recording material, an image heating member which heats the image on the recording material at a nip portion, first detecting means for detecting a temperature of a first region outside a region, which can be brought into contact with the recording material, of the image heating member in a width direction, when a set width of the recording material is a predetermined width, cooling means for cooling the first region of the image heating member in accordance with the output of the first detecting means, second detecting means for detecting a temperature of a second region at an end side in the width direction within the region, which can be brought into contact with the recording material, of said image heating member, when the set width of the recording material is the predetermined width and notification means for notifying abnormality in accordance with the output of the first detecting means and the output of the second detecting means, wherein the notification means notifies that the set width of the recording material does not match the predetermined width in a case where the detected temperature of the first detecting means is a normal temperature and the detected temperature of the second detecting means is an abnormal temperature, and the notification means notifies that the cooling means is abnormal in a case where the detected temperature of the second detecting means is a normal temperature and the detected temperature of the first detecting means is an abnormal temperature.

A still further object of the present invention will be apparent upon reading the following detailed description with reference to the accompanying drawings.

DESCRIPTION OF THE EMBODIMENTS

The present invention will more specifically be described in accordance with an embodiment. It is to be noted that the embodiment is one example of the best mode for carrying out the present invention, but the present invention is not limited to only various constitutions described in the embodiment. That is, various constitutions described in the embodiment can be replaced with another known constitution within the scope of the idea of the present invention.

Embodiment 1

(1) Image Forming Section

Figure 5:
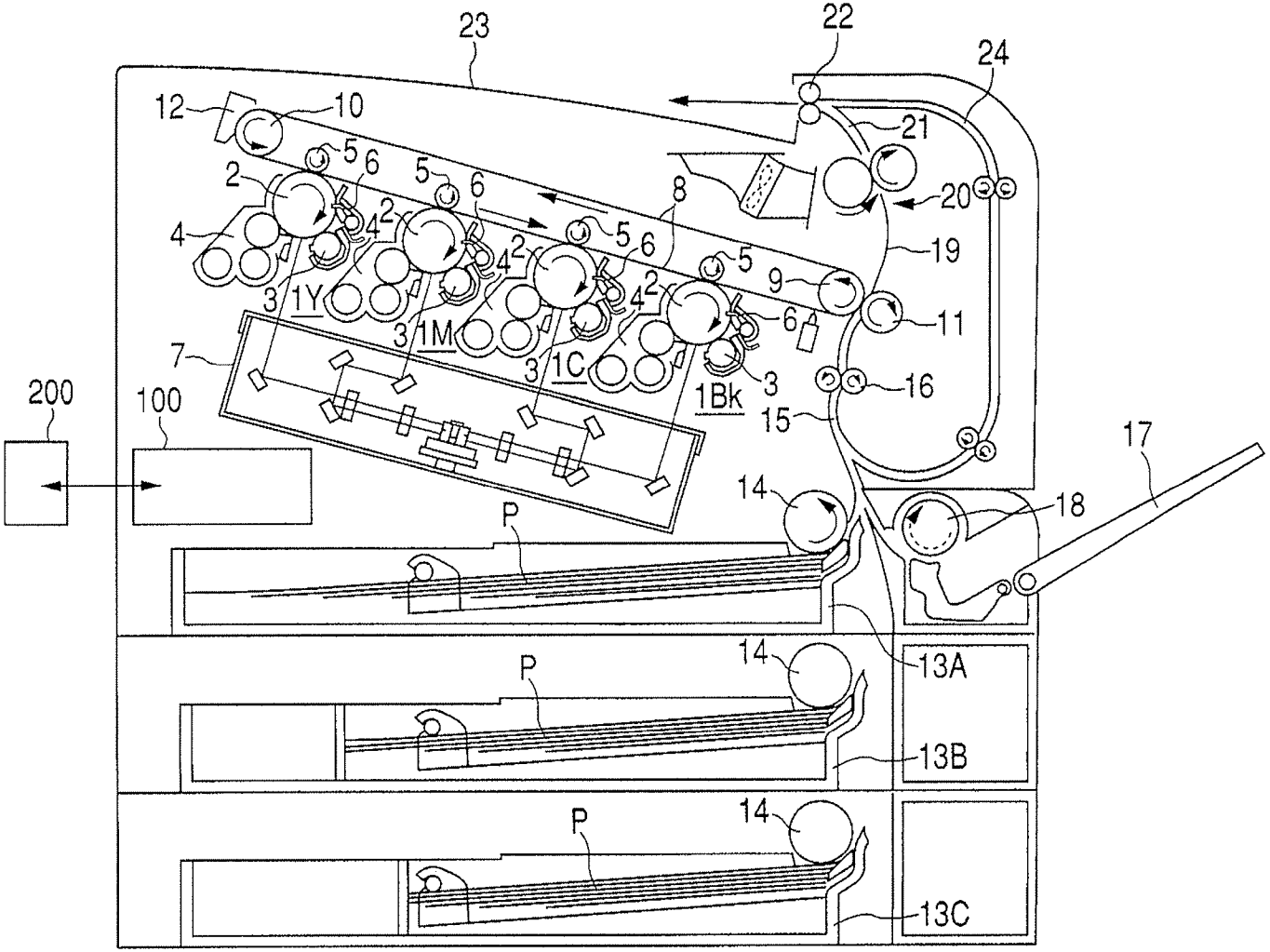
FIG. 5 is a schematic longitudinal sectional view of one example of an image forming apparatus on which the fixing apparatus is mounted.

FIG. 5 is a schematic longitudinal sectional view showing a schematic constitution of an electrophotography full color printer which is one example of an image forming apparatus of the present invention. First, there will be described an outline of an image forming section as image forming means for forming an unfixed image on a recording material.

This printer operates to form an image in accordance with input image information from an external host device 200 communicatably connected to a control circuit section (control substrate: CPU) 100. The printer can form a full color image on the recording material to output the image. The external host device 200 is a computer, an image reader or the like. The control circuit section 100 transmits and receives a signal with respect to the external host device 200. The section also transmits and receives signals with respect to various image forming apparatuses, and executes an image forming sequence control.

Reference numeral 8 denotes an endless and flexible intermediate transferring belt (hereinafter referred to simply as the belt), and the belt is extended between a secondary transferring counter roller 9 and a tension roller 10. When the roller 9 is driven, the roller 8 is rotated in a counterclockwise direction as shown by arrows at a predetermined speed. Reference numeral 11 denotes a secondary transferring roller, and this roller is brought into contact under pressure with the secondary transferring counter roller 9 via the belt 8. An abutment portion between the belt 8 and the secondary transferring roller 11 is a secondary transferring part.

Characters 1Y, 1M, 1C and 1Bk are first to fourth, four image forming sections, and the sections are arranged in one row at predetermined intervals along a belt movement direction under the belt 8. Each of the image forming sections is an electrophotography process mechanism of a laser exposure system, and has a drum type electrophotography photosensitive member (hereinafter referred to as the drum 2) as an image bearing body rotated in a clockwise direction as shown by an arrow at a predetermined speed. Around each drum 2, there are arranged a primary charging device 3, a developing apparatus 4, a transferring roller 5 as transferring means and a drum cleaning device 6. Each transferring roller 5 is disposed in the belt 8, and brought into contact under pressure with the corresponding drum 2 via a lower forward belt portion of the belt 8. An abutment portion between each drum 2 and the belt 8 is a primary transferring part. Reference numeral 7 denotes a laser exposing apparatus with respect to the drum 2 of each image forming section, and the apparatus is constituted of laser light emitting means which emits light in response to a time-series electric digital pixel signal of given image information, a polygon mirror, a reflective mirror and the like.

The control circuit section 100 operates each image forming section to form the image in accordance with a color decomposing image signal input from the external host device 200. Accordingly, in the first to fourth image forming sections 1Y, 1M, 1C and 1Bk, yellow, magenta, cyan and black color toner images are formed on the surfaces of the rotating drums 2, respectively, at predetermined control timings. It is to be noted that since electrophotography image forming principle and process for forming the toner image on each drum 2 are known, description thereof is omitted.

The above toner images formed on the surfaces of the drums 2 of the image forming sections are successively superimposed and transferred by the primary transferring parts, respectively, onto an outside surface of the belt 8 rotated at a speed corresponding to a rotation speed of each drums 2 in a forward direction along a rotation direction of each drum 2. Accordingly, on the surface of the belt 8, an unfixed full color toner image is synthesized by superimposing four toner images upon one another.

On the other hand, at a predetermined sheet feeding timing, there is driven a sheet feeding roller 14 of a sheet feeding cassette of a stage selected from multiple vertical stages of cassette sheet feeding sections 13A, 13B and 13C on which recording materials P having various width sizes are stacked and stored, respectively. Accordingly, one sheet is separately fed from the recording material P stacked and stored in the sheet feeding cassette of the stage, and the sheet passes through a vertical conveyance path 15, and is conveyed to registration rollers 16. When manual sheet feeding is selected, a sheet feeding roller 18 is driven. Accordingly, one sheet is separately fed from the recording material stacked and set on a manual insertion tray (multi purpose tray) 17, and the sheet passes through the vertical conveyance path 15, and is conveyed to the registration rollers 16.

The registration rollers 16 convey the recording material P at such a timing that a leading edge of the recording material P reaches the secondary transferring part in accordance with a timing when a leading edge of the full color toner image on the rotating belt 8 reaches the secondary transferring part. Accordingly, in the secondary transferring part, the full color toner images on the belt 8 are all successively secondary-transferred to the surface of the recording material P. The recording material which has exited from the secondary transferring part is separated from the surface of the belt 8, guided by a vertical guide 19, and introduced into a fixing apparatus (fixing device) 20. This fixing apparatus 20 melts and mixes the plurality of colors of toner images, and the images are fixed as permanently fixed images on the surface of the recording material. The recording material which has exited from the fixing apparatus 20 passes as a full color image formed material through a conveyance path 21, and fed out onto a discharge tray 23 by discharge rollers 22.

In the secondary transferring part, the surface of the belt 8, from which the recording material has been separated, is subjected to removal of residual deposits such as residual toner of the secondary transferring, cleaned, and repeatedly used in forming the image.

In a monochromatic printing mode, the only fourth image forming section Bk which forms a black toner image is operated and controlled to form the image. In a case where a double-sided printing mode is selected, the recording material having its first surface printed is fed out onto the discharge tray 23 by the discharge roller 22. The rotation of the discharge rollers 22 changes to backward rotation immediately before a trailing edge of the material passes through the discharge rollers 22. Accordingly, the recording material is switched back and introduced into a re-convey path 24. Moreover, a front surface and a rear surface of the material are reversed, and the material is conveyed to the registration rollers 16 again. Thereafter, in the same manner as in the printing of the first surface, the material is conveyed to the secondary transferring part and the fixing apparatus 20, and fed out onto the discharge tray 23 as the material having the double surfaces printed with the image.

(2) Fixing Apparatus 20

The fixing apparatus or members constituting the apparatus will be described hereinafter. In the following description, a longitudinal direction is a direction parallel to a direction crossing a recording material conveyance direction at right angles in the surface of the conveyance path of the recording material. With respect to the fixing apparatus, a front of the apparatus indicates the surface of the apparatus on the side of introduction of the recording material, and left/right indicates the left or the right as viewed from the front of the apparatus. The width of the recording material indicates a dimension of the recording material in the direction crossing the recording material conveyance direction at right angles in the surface of the recording material.

Figure 4:
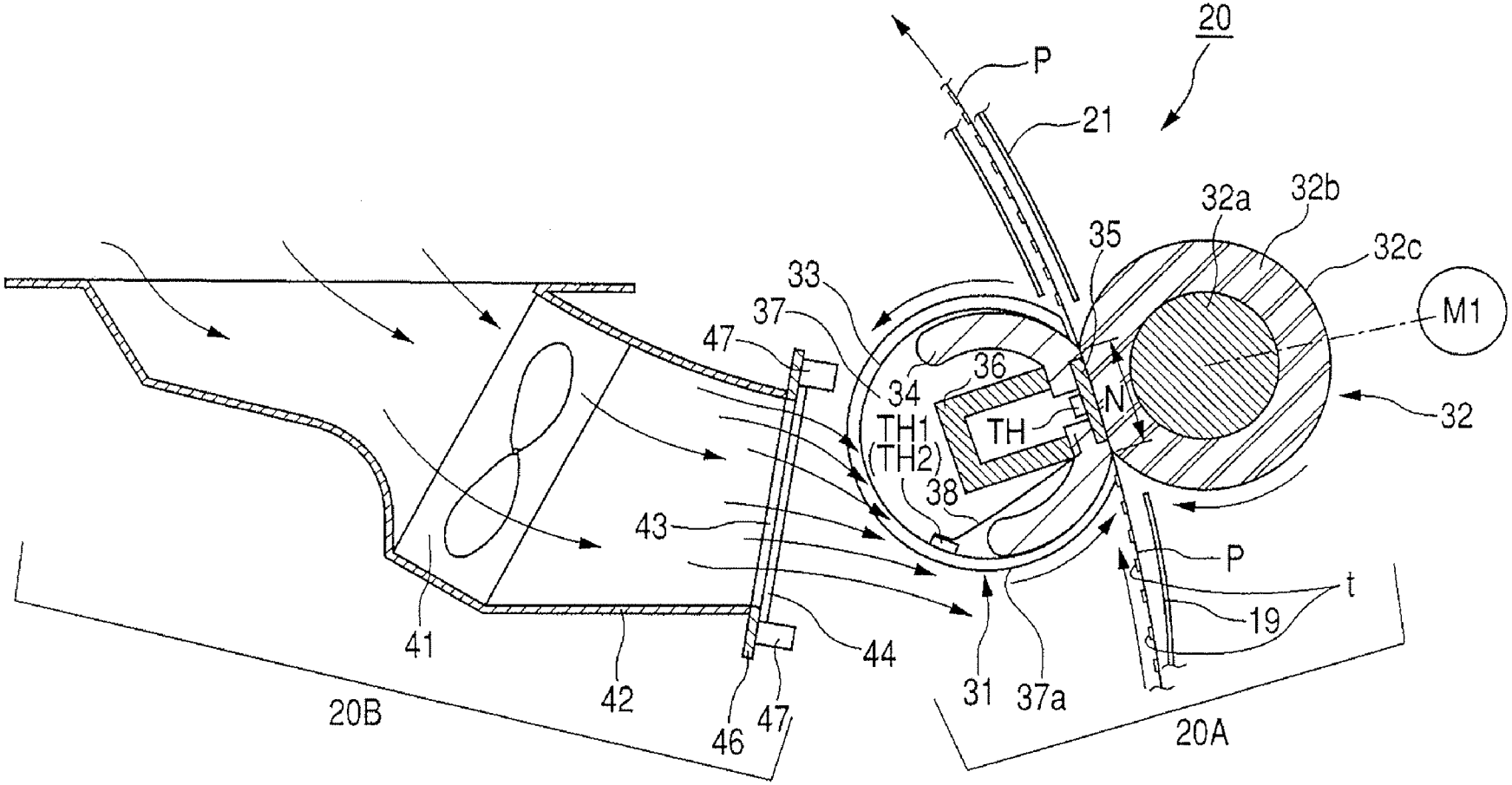
FIG. 4 is a schematic transverse sectional view showing a schematic constitution of a fixing apparatus (image heating apparatus) of an embodiment.
Figure 6:
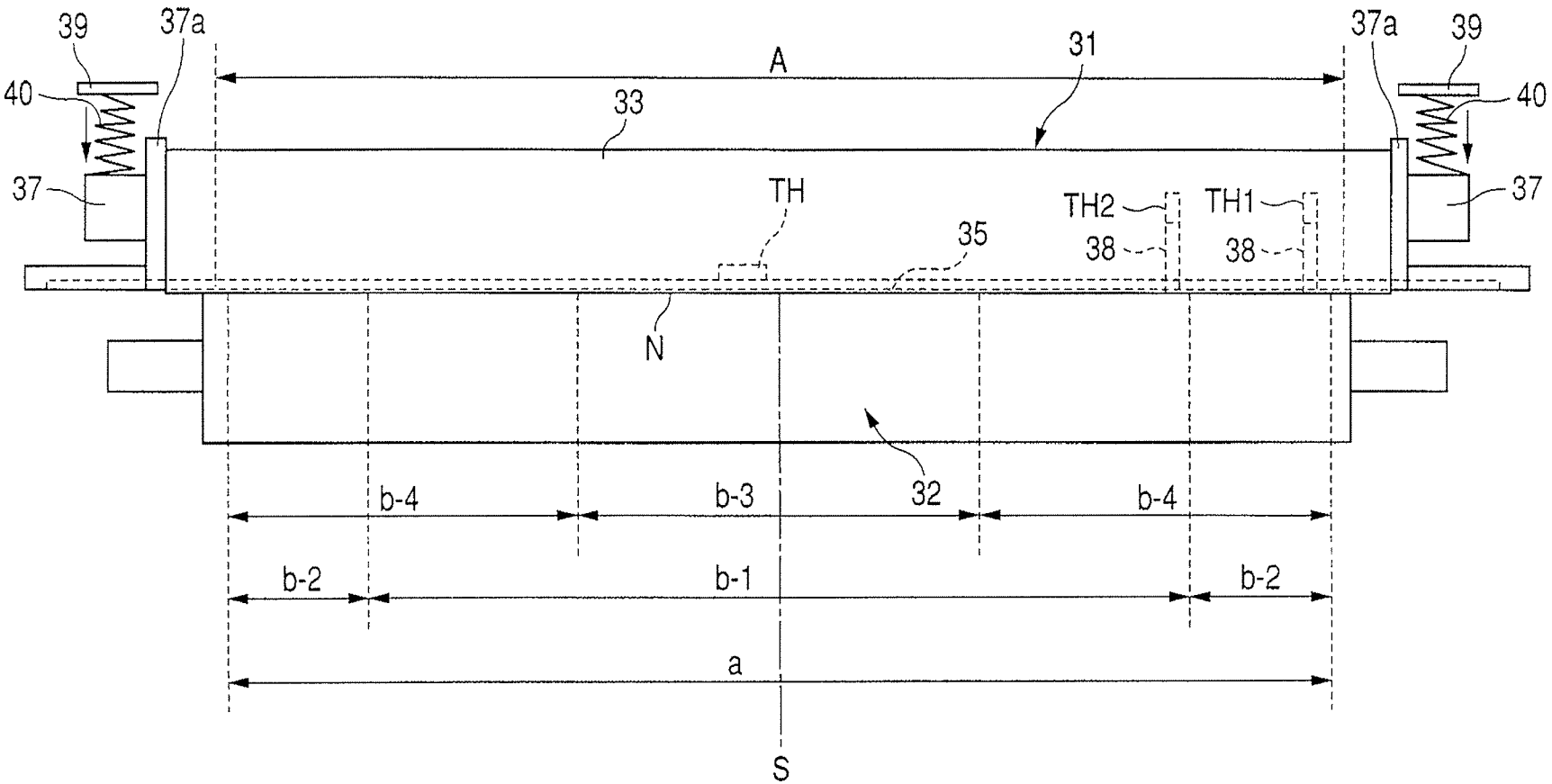
FIG. 6 is a schematic front view of a fixing mechanism portion of the fixing apparatus.
Figure 7:
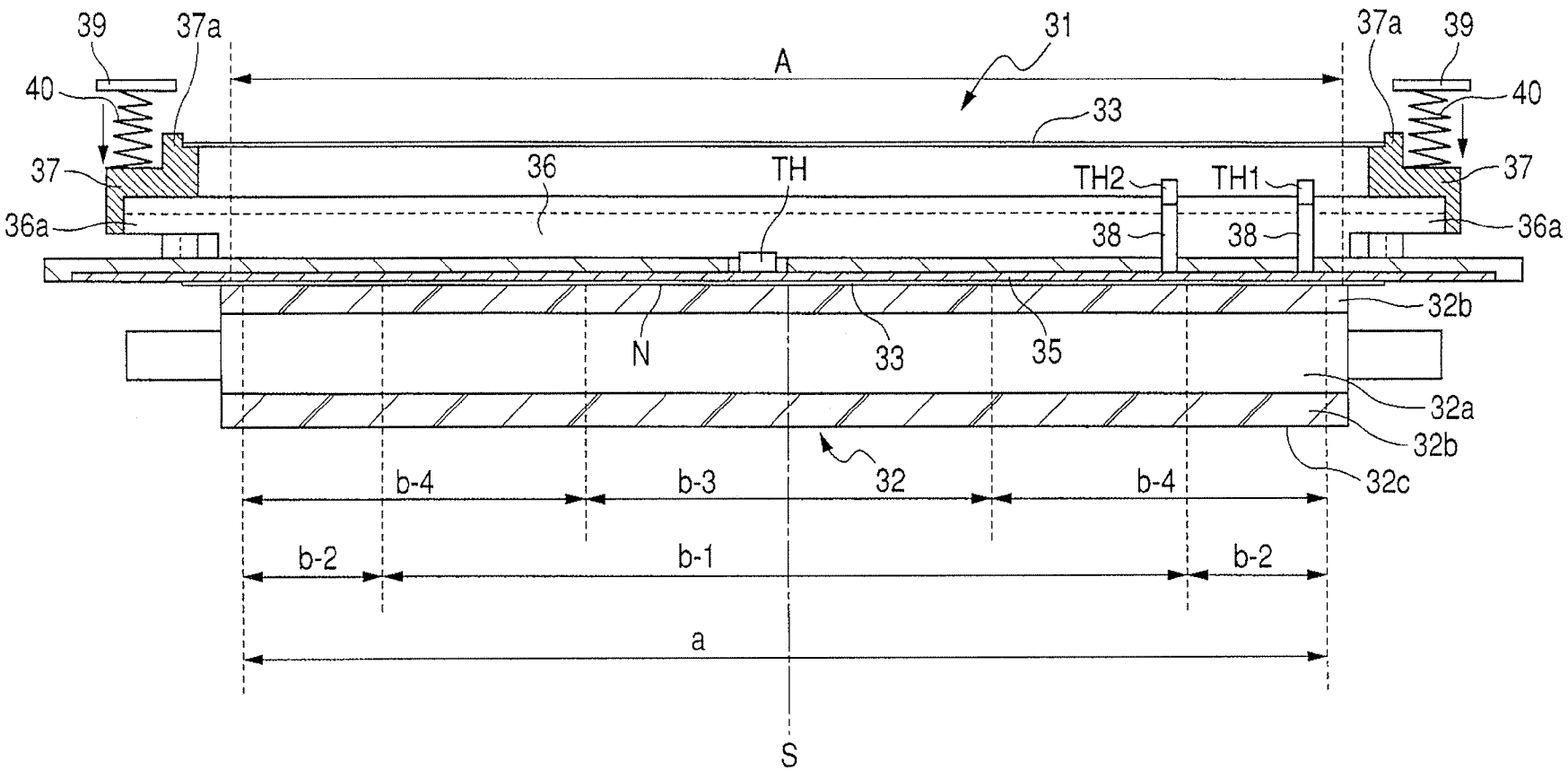
FIG. 7 is a schematic longitudinal front view of the fixing mechanism portion.

FIG. 4 is a schematic transverse sectional view showing a schematic constitution of the fixing apparatus 20 as an image heating apparatus of the present embodiment. This fixing apparatus 20 is roughly constituted of a fixing mechanism section 20A of a film (belt) heating system and a blower cooling mechanism section (cooling means) 20B. FIG. 6 is a schematic front view of the fixing mechanism section 20A, and FIG. 7 is a schematic longitudinal front sectional view of the section.

(2-1) Fixing Mechanism Section 20A

First, an outline of the fixing mechanism section 20A will be described. The fixing mechanism section 20A is basically an on-demand fixing apparatus of a film heating system and a pressurizing rotary member driving system (tensionless type) disclosed in Japanese Patent Application Laid-Open Nos. 4-44075 to 44083 and 4-204980 to 204984.

Reference number 31 denotes a film assembly as a fixing member (heating member), and 32 denotes an elastic pressurizing roller as a second fixing member (pressurizing member). Both of the members are brought into contact under pressure with each other to form a fixing nip (sheet passing nip) portion N.

In the film assembly 31, reference numeral 33 denotes a cylindrical flexible fixing film (fixing belt, thin roller: hereinafter simply referred to as the film) as an image heating member which heats the image on the recording material in the nip portion. Reference number 34 denotes a film guide member (hereinafter simply referred to as the guide member) having a substantially semi-circular trough-like transverse section and having heat resistance and rigidity. A ceramic heater 35 (hereinafter simply referred to as the heater) as a heating source is fixedly fitted into a concave groove portion disposed along the longitudinal direction of the member. The film 33 is loosely fitted into an outer periphery of the guide member 34 attached to the heater 35. Reference number 36 denotes a rigid pressurizing stay (hereinafter simply referred to as the stay) having a U-shaped transverse section, and the stay is disposed in the guide member 34. Reference number 37 denotes end-portion holders fitted into outwardly protruding arm portions 36*a* of opposite left and right end portions of the stay 36, and 37*a* denotes flange portions integrated with the end-portion holders 37.

The pressurizing roller 32 has its hardness lowered by disposing an elastic layer 32*b* on a core grid 32*a*. To enhance a surface property, a resin layer 32*c* made of fluorine such as PTFE, PFA or FEP may be disposed on an outer periphery of the roller. The pressurizing roller 32 is rotatably disposed as a pressurizing rotary member by disposing opposite end portions of the core grid 32*a* via a bearing member between left and right side plates of an apparatus chassis (not shown).

The film assembly 31 is disposed in parallel with the pressurizing roller 32 so that the film assembly faces the pressurizing roller on the side of the heater 35, and pressurizing springs 40 in contracted states are disposed between the left and right end-portion holders 37 and left and right spring bearing members 39 fixed. Accordingly, the stay 36, the guide member 34 and the heater 35 are pressed and urged on the side of the pressurizing roller 32. This pressing urging force is set to a predetermined force, and the heater 35 is brought into contact under pressure with pressurizing roller 32 with the film 33 being sandwiched therebetween against elasticity of the elastic layer 32*b*, thereby forming the fixing nip portion N having a predetermined width in the recording material conveying direction between the film 33 and the pressurizing roller 32.

Figure 8:
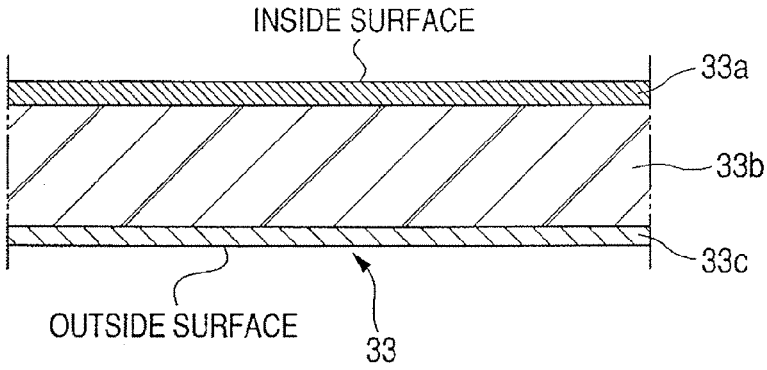
FIG. 8 is a layer constitution model diagram of a fixing film.

In the present embodiment, as shown in a schematic layer constitution diagram of FIG. 8, the film 33 has a three-layer complex structure including a base layer 33*a*, an elastic layer 33*b* and a mold release layer 33*c* in order from an inside surface side to an outside surface side. To reduce a thermal capacity and enhance a quick start property, in the base layer 33*a*, there can be used a heat-resistant film having a film thickness of 100 μm or less, preferably 50 μm or less and 20 μm or more. For example, there can be used a film made of polyimide, polyimide amide, PEEK, PES, PPS, PTFE, PFA or FEP. In this example, a cylindrical polyimide film having a diameter of 25 μm was used. As the elastic layer 33*b*, a silicone rubber was used in which a rubber hardness was 10 degrees (JIS-A), a thermal conductivity was 4.18605'10 1 W/m·degree (1'10 3 [cal/cm.sec.deg]) and a thickness was 200 mm. As the mold release layer 33*c*, a PFA coating layer having a thickness of 20 mm was used. A PFA tube may be used. The PFA coating is excellent in that the layer can be formed to be thin, and this material has a greater effect of wrapping toner as compared with the PFA tube. On the other hand, since the PFA tube has more excellent mechanical and electric strengths as compared with the PFA coating, the materials can selectively be used as the case may be.

Figure 9:
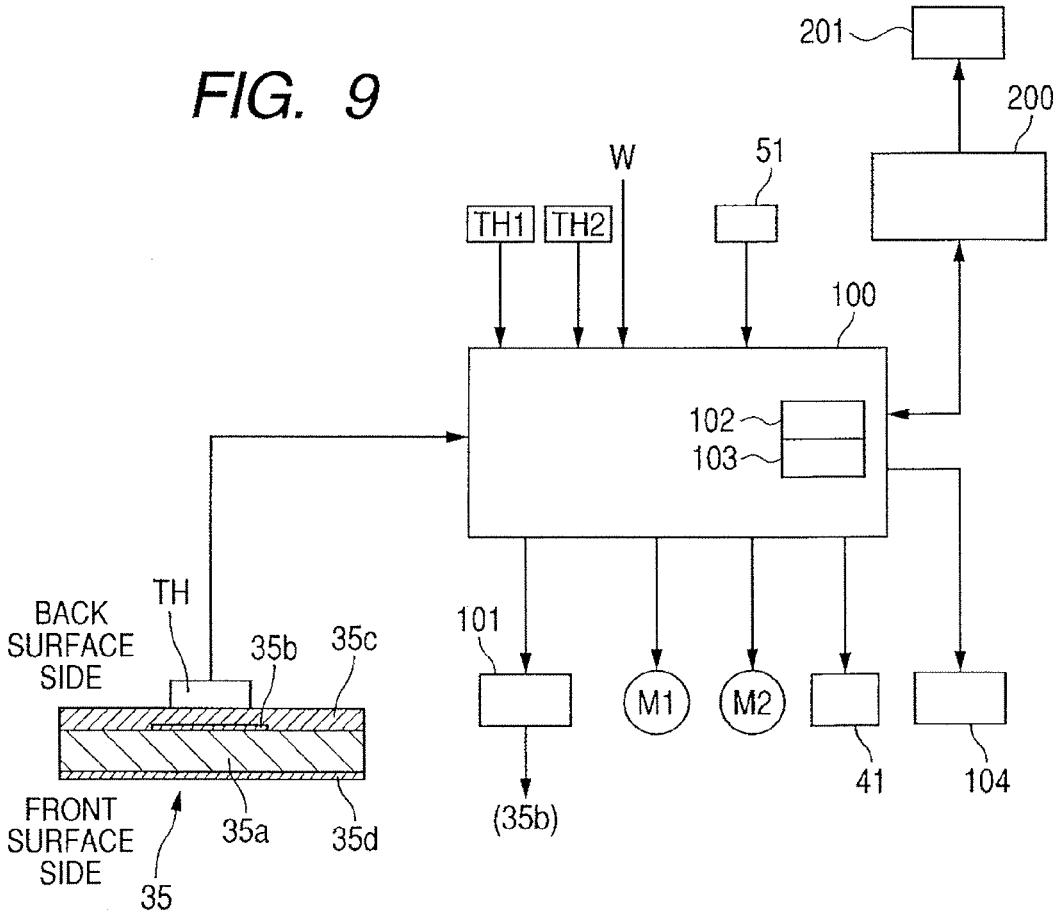
FIG. 9 shows a transverse sectional model diagram of a heater and a block diagram of a control system.

In the present embodiment, the heater 35 is of a back-surface heating type using aluminum titanate or the like as a heater substrate, and is a linearly heating member having a small thermal capacity and being laterally long with respect to a direction crossing a movement direction of the fixing film 33 and the recording material P at right angles. FIG. 9 shows a schematic transverse sectional view and a control system diagram of the heater 35. This heater 35 has a heater substrate 35*a* made of aluminum titanate or the like. On a back surface side (the side of the surface opposite to the side of the surface facing the fixing film) of this heater substrate 35*a*, an electric heat generating layer 35*b* is disposed along the longitudinal direction by screen-printing or otherwise applying an electric resistant material such as silver/palladium (Ag/Pd) having a thickness of about 10 mm and a width of 1 to 5 mm. Further on the layer, a protective layer 35*c* is disposed which is made of glass, fluorine resin or the like. In the present embodiment, a sliding member (lubricant member) 35*d* is disposed on the front surface side (the side of the surface facing the film) of the heater substrate 35*a*.

The heater 35 is fitted into a groove portion formed substantially in the center of the outside surface of the guide member 34 along a guide longitudinal direction, and fixedly supported so that the heater is exposed on the front surface side of the heater substrate provided with the sliding member 35*d*. In the fixing nip portion N, the surface of the sliding member 35*d* of this heater 35 is brought into sliding contact with the inside surface of the film 33. Moreover, the film 33 as a rotating image heating member is heated by the heater 35.

When the heater 35 is energized between opposite longitudinal ends of the electric heat generating layer 35*b*, the electric heat generating layer 35*b* generates heat so that the heater 35 rapidly raises its temperature in the whole region having an effective heat generating width A of the heater longitudinal direction. The heater temperature (i.e., the temperature of the film 33) is detected by main equal to detecting means (hereinafter referred to as the main thermistor) TH brought into contact with the outside surface of the heater protective layer 35*c*. Moreover, an output (signal value concerning the temperature) of the main thermistor is input into the control circuit section 100 via an A/D converter. Based on detected temperature information input from the main thermistor, the control circuit section 100 controls energization from a power source (power supply section, heater driving circuit) 101 to the electric heat generating layer 35*b* so that the heater temperature is retained at a predetermined fixing temperature. That is, the temperature of the film 33 as a heating rotary member to be heated by the heater 35 is adjusted at a predetermined fixing temperature by the control circuit section 100 in response to an output of the main thermistor TH.

The pressurizing roller 32 is rotated in a counterclockwise direction as shown by an arrow by a motor (driving means) M1. A rotating force acts on the film 33 owing to a frictional force in the fixing nip portion N between the outside surfaces of the pressurizing roller 32 and the film 33 by the rotation of this pressurizing roller 32. Accordingly, the film 33 rotates around the outer periphery of the guide member 34 in the counterclockwise direction as shown by the arrow while the outside surface of the film is closely attached to the heater 35, and slides in the fixing nip portion N (pressurizing roller driving system). The film 33 rotates with a peripheral speed which substantially corresponds to a peripheral rotation speed of the pressurizing roller 32. The left and right flange portions 37*a* have functions of receiving the moved end portions of the film 33 to regulate movement, when the rotating film moves to the left or the right along the longitudinal direction of the guide member 34. To reduce a mutual sliding frictional force between the heater 35 and the inside surface of the film 33 in the fixing nip portion N, the sliding member 35*d* is disposed on the heater surface of the fixing nip portion N, and a lubricant such as a heat-resistant grease is interposed between the heater and the inside surface of the film 33.

Moreover, the rotation of the pressurizing roller 32 is started based on a print start signal, and heat-up of the heater 35 is also started. In a state in which the peripheral rotation speed of the film 33 is set to be stationary, and the temperature of the heater 35 rises at a predetermined temperature, the recording material P bearing a toner image t is introduced into the fixing nip portion N while the surface of the material bearing the toner image faces the film 33. The recording material P comes into close contact with the heater 35 via the film 33 in the fixing nip portion N to pass through the fixing nip portion N together with the film 33. In this moving process, heat is applied to the recording material P by the film 33 heated by the heater 35 to heat and fix the toner image t onto the surface of the recording material P. The recording material P which has passed through the fixing nip portion N is separated from the surface of the film 33, discharged and conveyed.

In the present embodiment (FIG. 6), the recording material P is conveyed by so-called center reference conveyance centering on the recording material. That is, as to the recording material usable in the apparatus, passable through the apparatus and having any size of width, the center of the material in the width direction passes through the center of the film 33 in the longitudinal direction. Character S denotes a sheet passing reference line (virtual line) indicating the center of the recording material.

Character a denotes a sheet passing width (maximum sheet passing width) of the passable recording material having the maximum width. The width is, for example, 297 mm at a time when a sheet having a size A3 is vertically fed. The effective heat generating region width A in the heater longitudinal direction is set to be slightly larger than this maximum sheet passing width a.

Character b-1 denotes a sheet passing width (first sheet passing width) of a recording material having a width which is a size smaller than the maximum sheet passing width a. The width is, for example, 210 mm at a time when a sheet having a size A5 is laterally fed. Character b-2 denotes a width difference between the maximum sheet passing width a and the sheet passing width b-1, that is, non-sheet-passing portions (first non-sheet-passing regions) generated when the recording material having the sheet passing width b-1 is passed.

Character b-3 denotes a sheet passing width (second sheet passing width) of a recording material having a width which is a size smaller than the sheet passing width b-1. The width is, for example, 100 mm at a time when a sheet having a postcard size is vertically fed. Character b-4 denotes a width difference between the maximum sheet passing width a and the sheet passing width b-3, that is, non-sheet-passing portions (second non-sheet-passing regions) generated when the recording material having the sheet passing width b-3 is passed.

The above-described main thermistor TH is disposed to detect the heater temperature (=sheet passing portion temperature) in a position substantially corresponding to the recording material center sheet-passing reference line S along which the large or small recording material having any sheet passing width passes.

Characters TH1 and TH2 are first and second end-portion temperature detecting means. The first end-portion temperature detecting means is referred to as the first end-portion thermistor. Temperature detection by this first end-portion thermistor TH1 is referred to as the first temperature detection. The second end-portion temperature detecting means is referred to as the second end-portion thermistor. Temperature detection by this second end-portion thermistor TH2 is referred to as the second temperature detection.

The first end-portion thermistor TH1 is disposed so as to detect the film temperature in an inner position from the vicinity of the end portion of the maximum sheet passing width a.

Moreover, the second end-portion thermistor TH2 is disposed outside the end portion of the sheet passing region of the minimum passable recording material (e.g., vertically fed postcard size) in a region which is not cooled by cooling means described later.

Accordingly, in FIGS. 6 and 7, the first end-portion thermistor TH1 can detect the film temperature of a portion corresponding to the first non-sheet-passing region b-2. The second end-portion thermistor TH2 can detect the film temperature of a portion corresponding to the second non-sheet-passing region b-4.

Specifically, the first and second end-portion thermistors TH1 and TH2 are disposed on free ends of elastic support members 38 having leaf spring ships and having their base portions fixed to the guide member 34, respectively. Moreover, a temperature detection portion is allowed to elastically abut on the inside surface of the base layer 33*a* of the film 33 by elasticity of the elastic support member 38 so that the temperature of a film portion is detected. Outputs of the end-portion thermistors TH1, TH2 are input into the control circuit section 100 via the A/D converter.

(2-2) Blower Cooling Mechanism Section 20B

Figure 10:
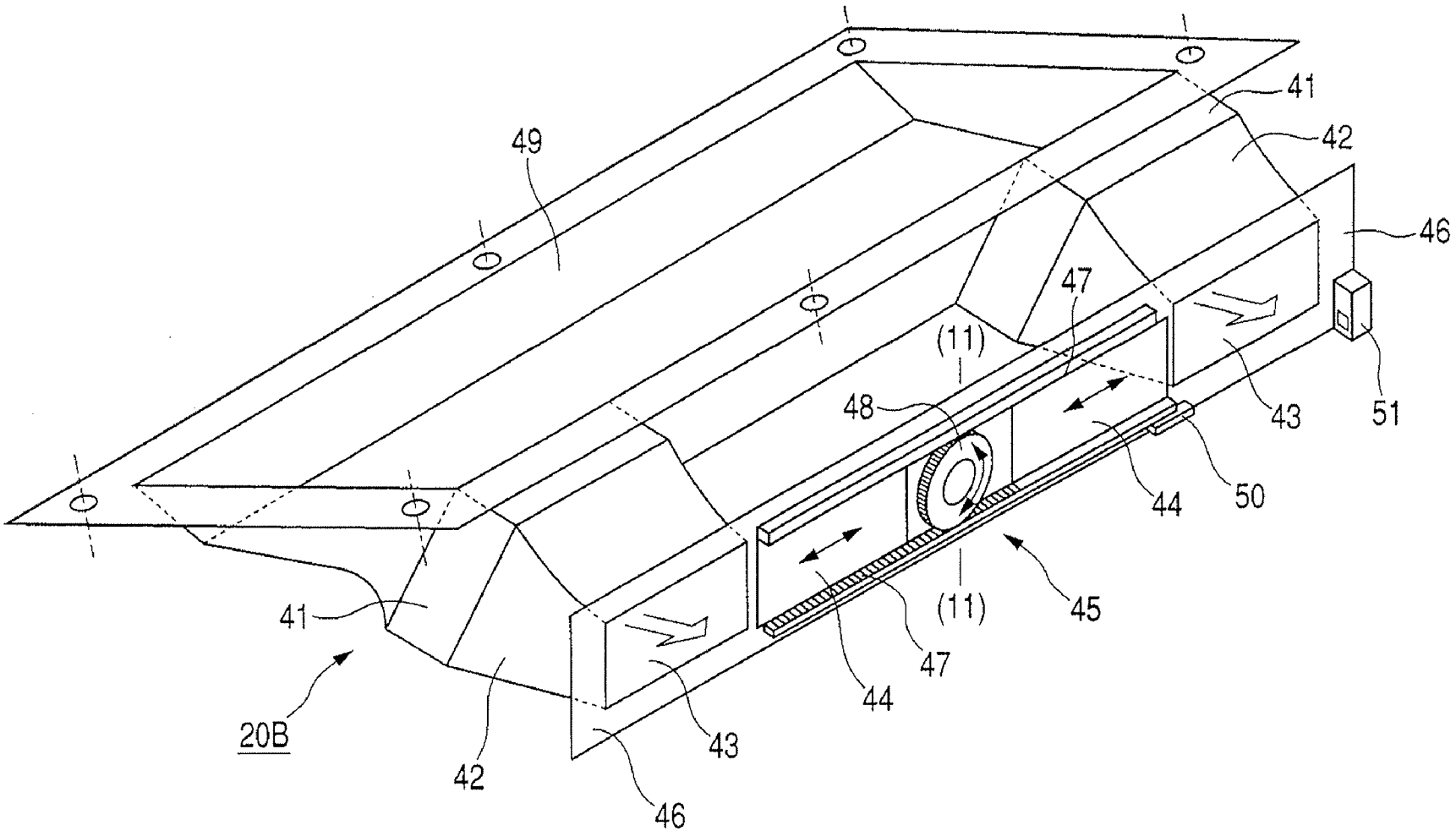
FIG. 10 is a schematic perspective view of an appearance of a blower cooling mechanism portion.
Figure 11:
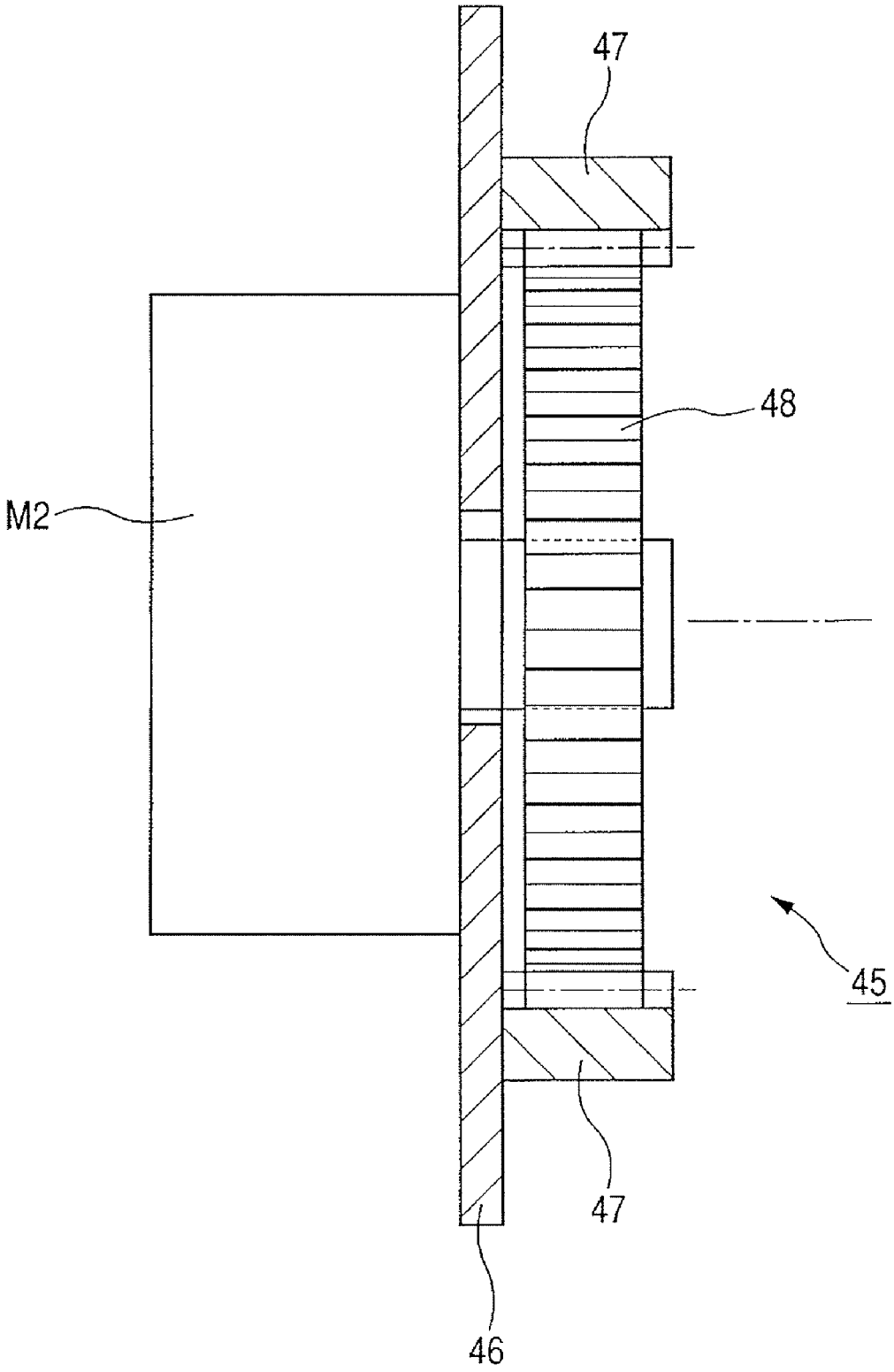
FIG. 11 is an enlarged sectional view cut along the (11)-(11) line of FIG. 10.

The blower cooling mechanism section 20B is cooling means for blowing air to lower temperature rises of the first non-sheet-passing regions b-2 of the fixing mechanism section 20A. FIG. 10 is a schematic perspective view of an appearance of this blower cooling mechanism section 20B. FIG. 11 is an enlarged sectional view cut along the (11)-(11) line of FIG. 10.

The blower cooling mechanism section 20B of the present embodiment will be described with reference to FIGS. 4, 10 and 11. The blower cooling mechanism section 20B has: blower (cooling) fans (blowing devices, hereinafter simply referred to as the fans) 41, cooling ducts 42 which guide cooling air generated by the fans 41, and blower ports (duct openings) 43 disposed in portions of the cooling ducts 42 facing the fixing mechanism section 20A. The section also has shutters (shield plates) 44 which adjust opening widths of the blower ports 43 into widths suitable for the width of the recording material to be passed, and a shutter driving device (opening width adjusting means) 45 which drives the shutters.

The above-described fans 41, cooling ducts 42, blower ports 43 and shutters 44 are symmetrically arranged in left and right portions of the film 33 in the longitudinal direction. Reference number 49 denotes a suction channel portion disposed on a suction side of the fans 41. In the fans 41, a centrifugal fan such as a sirocco fan is usable.

The left and right shutters 44 are supported to be slidable in a left/right direction along a plate surface of a support plate 46 having the blower ports 43 formed therein and extending in the left/right direction. The left and right shutters 44 are allowed to communicate with each other by rack teeth 47 and a pinion gear 48, and the pinion gear 48 is rotated forwards or backwards by a motor (pulse motor) M2. Accordingly, the left and right shutters 44 are interlocked, and opened and closed in a symmetric relation with respect to the corresponding blower ports 43, respectively. The support plate 46, the rack teeth 47, the pinion gear 48 and the motor M2 described above constitute the shutter driving device 45.

Widths of the left and right blower ports 43 correspond to the widths of the first non-sheet-passing regions b-2, respectively. The left and right shutters 44 are arranged in such a direction as to close the blower ports 43 as much as predetermined amounts outwardly from the center of the support plate 46 in the longitudinal direction.

Into the control circuit section 100, width information W (see FIG. 9) of the recording material to be passed is input based on recording material size information set/indicated by a user by display means 104. It is to be noted that into the constitution, there is input information of a mechanism for automatically detecting the recording material width (mechanism for detecting a position of a recording material set lever), which is disposed in a sheet feeding cassette 13 or the manual insertion tray 17. Moreover, the control circuit section 100 controls the fans 41 and the shutter driving device 45 based on the information.

Figure 12:
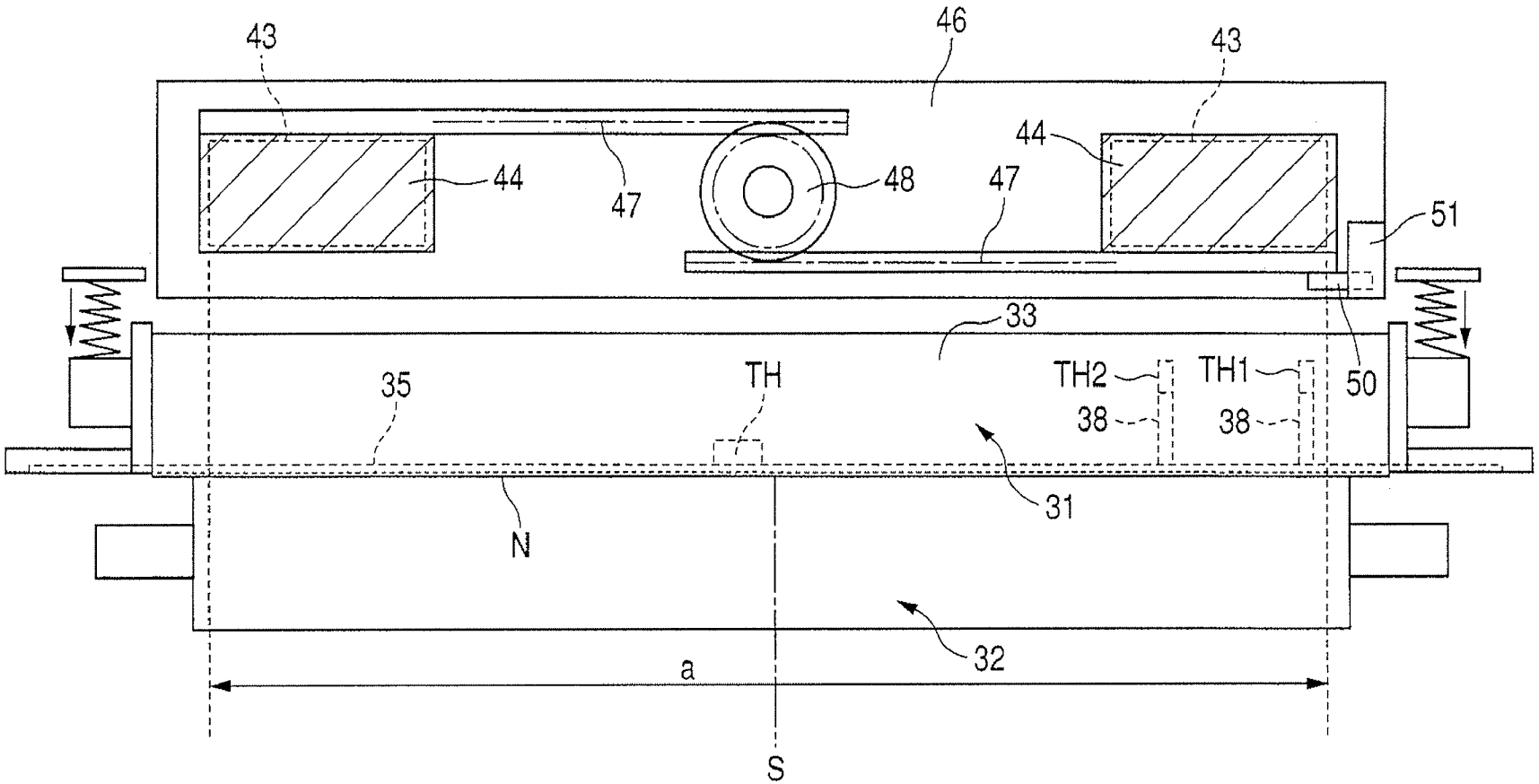
FIG. 12 is a state diagram in which a shutter moves to a completely closed position where the shutter completely closes a blower port.

That is, in the control circuit section 100, in a case where the width information of the recording material to be passed indicates a large-sized recording material having a width size of vertically fed A3, since cooling is not required, the fans 41 are turned off. As shown in FIG. 12, a state is brought about in which the blower ports 43 are completely closed with the shutters 44.

Figure 13:
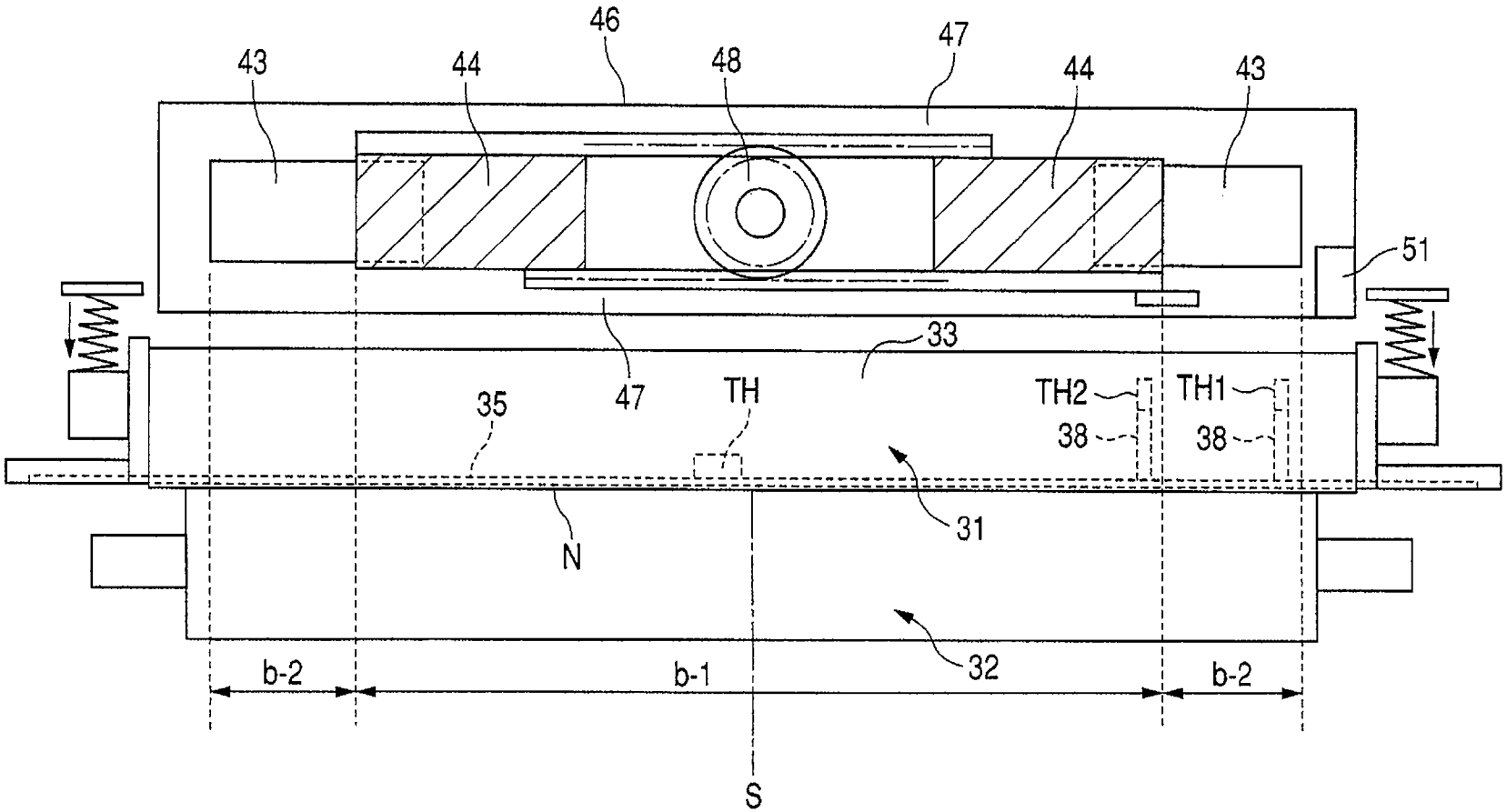
FIG. 13 is a state diagram in which a shutter moves to a completely open position where the shutter completely opens the blower port.

When the information indicates a small-sized recording material having a width of laterally fed A5, as shown in FIG. 13, the shutters 44 are moved to completely opened positions where the blower ports 43 are completely opened. Moreover, when the temperature detected by the first end-portion thermistor TH1 is not less than a predetermined upper-limit temperature, the fans 41 are turned on. Accordingly, the first non-sheet-passing portions b-2 are cooled. When the temperature of each first non-sheet-passing portion b-2 is below a predetermined lower-limit temperature, the fans 41 are turned off. The temperature rises of the first non-sheet-passing regions b-2 are adjusted into an allowable range by such ON-OFF controls of the fans 41.

When the width of the recording material to be passed is smaller than the maximum sheet passing width a, and larger than the width of the first sheet passing region b-1, the control circuit section 100 moves the shutter 44 to a position where the blower port 43 is opened as much as the non-sheet-passing portion generated in this case. Moreover, the temperature rise of the non-sheet-passing region is adjusted into an allowable range by the ON-OFF control of the fans 41 in accordance with the temperature detected by the first end-portion thermistor TH1.

To obtain positional information of the shutter 44, a flag 50 disposed in a predetermined position of the shutter 44 is detected by a sensor 51 disposed on the support plate 46. Specifically, a home position is determined in a shutter position where the blower port 43 is completely closed as shown in FIG. 12, and an opening amount is detected from a rotation amount of the motor M2.

There may be disposed an opening width detecting sensor which directly detects the present position of the shutter 44. The shutter positional information obtained by the sensor is fed back to a control circuit, and the shutter 44 can be moved under control to an appropriate opening width position in accordance with the width of the recording material to be passed. As to a stop position of the shutter, a shutter edge position is detected with the sensor to determine the position with good precision in accordance with the length of the small-sized recording material in the width direction. Therefore, the cooling air can be blown to the only non-sheet-passing regions of the small-sized recording material having a size which is smaller than the maximum sheet passing width a and larger than the width of the first sheet passing region b-1.

When the width of the recording material to be passed is smaller than that of the first sheet passing region b-1, the blower cooling mechanism section 20B is not operated. That is, the control circuit section 100 turns off the fans 41. Moreover, the blower ports 43 are completely closed with the shutters 44. Furthermore, when the temperature detected by the first or second end-portion thermistor TH1 or TH2 is not less than the predetermined upper-limit temperature, throughput down control is performed.

Here, the throughput down control is a control to reduce the number of the recording materials to be passed through the fixing nip portion N per unit time. Specifically, there are methods a, b and c as follows.

a: An interval between the recording materials to be passed through the fixing apparatus is increased to lower a non-sheet-passing region temperature.

b: While the interval between the recording materials to be passed through the fixing apparatus is enlarged, a heating operation is stopped to lower the non-sheet-passing region temperature, when the recording material does not pass through the fixing region.

c: A discharge speed of the recording material of the fixing apparatus is reduced. The temperature rise of the non-sheet-passing portion of the second non-sheet-passing region b-4 is moderated by this throughput down control.

(3) Apparatus Abnormality Judgment Mode (3-1) Next, there will be described a control sequence to judge an abnormal state of the apparatus using the blower cooling mechanism 20B (cooling means), the first end-portion thermistor TH1 and the second end-portion thermistor TH2 of the present embodiment with reference to FIG. 1.

In FIG. 9, reference numeral 102 denotes judging means (judging function section) in the control circuit section 100, and the means judges whether or not an operation of cooling means is abnormal or setting of the recording material width is abnormal based on outputs of the first and second end-portion thermistors TH1 and TH2. The judging means 102 has notification means (notifying function section) for notifying the abnormality. The notification means 103 outputs a signal for displaying the abnormality to the display means 104 and/or 201. The display means 104 is display means (liquid crystal display unit or the like) disposed on the side of the image forming apparatus (printer). The display means 201 is display means (monitor such as a liquid crystal display unit or CRT) equipped or connected on the side of the external host device 200 connected to the image forming apparatus through a network.

First, the control circuit section (CPU) 100 issues a print job start signal (S100).

Next, during the printing, in a case where in S101, the first end-portion thermistor TH1 detects a temperature of T0 degrees or more (first temperature detection), the fans 41 (blowing devices) are operated to blow the cooling air for cooling the end portions of the fixing mechanism section 20A (S102).

In a case where the fans 41 operate, in a case where in S103, the first end-portion thermistor TH1 detects the temperature which is not less than a predetermined value of T1 degrees, the judging means 102 judges that the fans 41 do not normally operate (S104). Moreover, an error indicating this judgment is displayed in the display means 104 or 201 in response to the notification by the notification means 103, and the image forming apparatus is stopped (S105). The stopping of the image forming apparatus is synonymous with discontinuing of image forming.

There will be described a case where in S103, the temperature detected by the first end-portion thermistor TH1 is lower than T1 degrees but in S106, the temperature detected by the second end-portion thermistor TH2 (second temperature detection) is not less than T2 degrees.

In this case, the judging means 102 judges that the temperature is abnormally high owing to a certain factor in the vicinity of the second end-portion thermistor TH2 of the fixing mechanism section 20A. Moreover, the error indicating the judgment is displayed in the display means 104 or 201 in response to the notification by the notification means 103, and user's attention is called to generation of the abnormality (S107). Moreover, the apparatus is stopped (S108).

In a case where in S106, the second end-portion thermistor TH2 detects the temperature which is lower than T2 degrees, image forming processing is normally performed (S109). When all printing processing ends, a job ends (S110).

In a case where it is judged in S101 that the end portion of the fixing mechanism section 20A does not have to be cooled, and the blower cooling mechanism section 20B does not operate, the following sequence is performed.

In a case where it is detected in S111 that the temperature detected by the first end-portion thermistor TH1 is not less than a predetermined value of T1 degrees, the judging means 102 judges that the temperature is abnormally high for a certain factor in the vicinity of the first end-portion thermistor TH1 of the fixing mechanism section 20A. Moreover, the display means 104 or 201 displays the error indicating the judgment in response to the notification of the notification means 103 (S112), and the apparatus is stopped (S113).

It is judged in S111 that the temperature of the first end-portion thermistor TH1 is lower than the predetermined value of T1 degrees. Even when the second end-portion thermistor TH2 detects the temperature of T2 degrees or more (S114), however, the judging means 102 judges that the temperature is abnormally high for a certain factor in the vicinity of the second end-portion thermistor TH2 of the fixing mechanism section 20A (S115). Moreover, the display means 104 or 201 displays the error indicating the judgment in response to the notification of the notification means 103, and the apparatus is stopped (S116).

In a case where in S114, the second end-portion thermistor TH2 detects the temperature which is lower than T2 degrees, the image forming processing is normally performed (S109). When all the printing processing ends, the job ends (S110).

Figure 1:
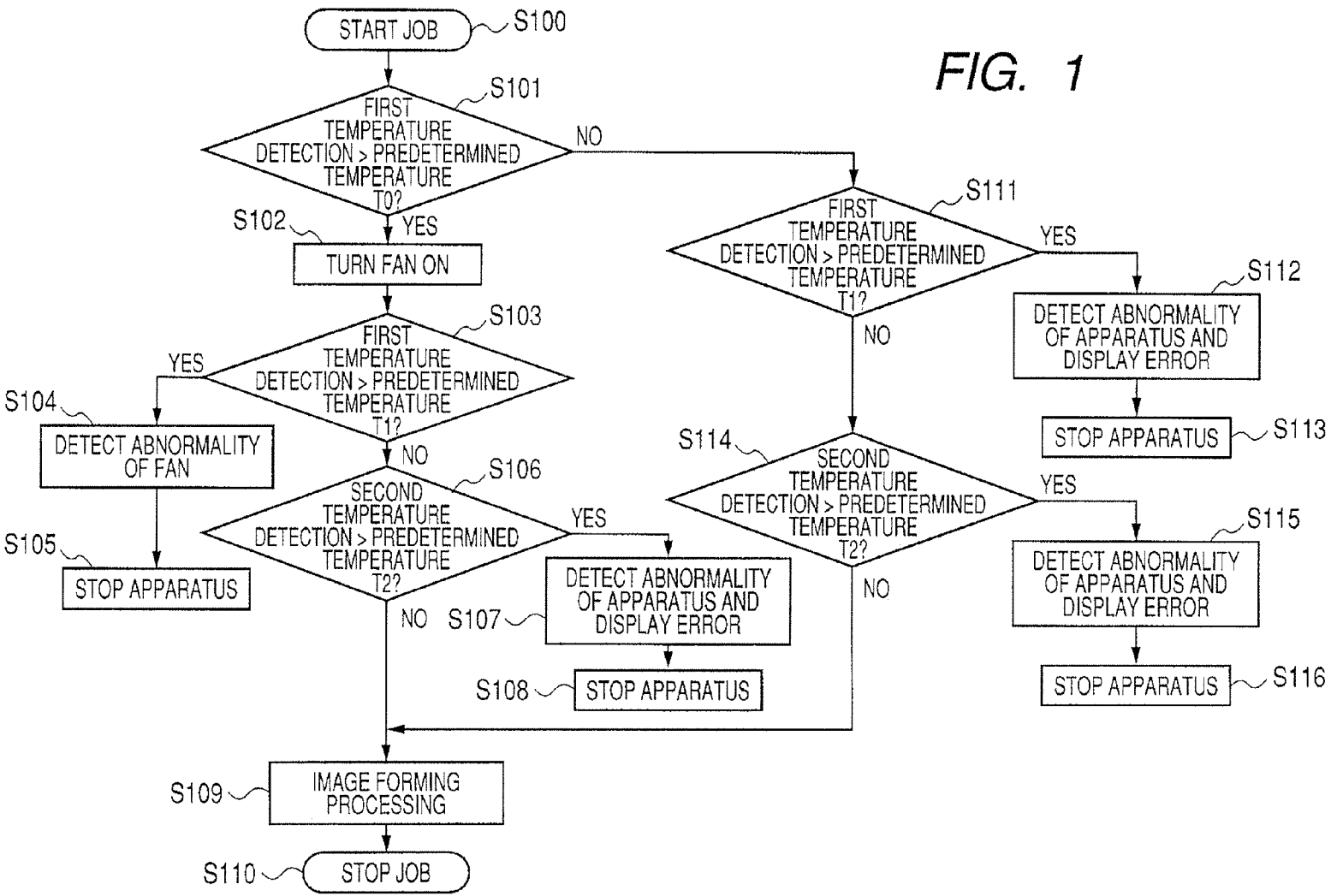
FIG. 1 is a flow chart of a control sequence to judge an abnormal state of an apparatus.

Thus, in the control sequence of FIG. 1, in a case where the first or second end-portion thermistor TH1 or TH2 detects the abnormally high temperature, it is judged that the certain abnormality is generated in the apparatus. The user's attention is called, and the apparatus is stopped.

(3-2) Next, there will be described a control sequence in which it is detected that the actually passed recording material has a size different from the recording material size set by the user with reference to a flow chart of FIGS. 2A and 2B.

First, it is assumed that the recording material size is set by the user as follows. That is, the size in the width direction of the fixing region is set to the maximum size between the regions b-2 described above. Alternatively, the size in the width direction of the fixing region may be set to the width size of the region b-3 which is not cooled by the blower cooling mechanism section 20B, outside the second end-portion thermistor TH2.

Moreover, the control circuit section 100 issues a print job start signal (S200).

Next, during the printing, in a case where in S201, the first end-portion thermistor TH1 detects the temperature which is T0 degrees or more, the fans 41 (blowing devices) are operated to blow the cooling air for cooling the end portions of the fixing mechanism section 20A (S202).

Next, in a case where in 203, the first end-portion thermistor TH1 detects the temperature which not less than a predetermined value of T1 degrees, the judging means 102 judges that the fans 41 do not normally operate (S204). Moreover, the error indicating the judgment is displayed in the display means 104 or 201 in response to the notification by the notification means 103, and the apparatus is stopped (S205).

In a case where in S203, the temperature detected by the first end-portion thermistor TH1 is lower than T1 degrees but in S206, the second end-portion thermistor TH2 detects T2 degrees or more, in S209, the set size of the recording material is judged.

Here, there will be described a case where the size of the recording material in the width direction of the fixing region is set, by the user, to a width size in the region b-3 which is not cooled by the blower cooling mechanism section 20B, outside the second end-portion thermistor TH2.

In this case, the judging means 102 judges that there has actually been passed the recording material having the recording material width size smaller than the set recording material width size (S210). Moreover, the display means 104 or 201 displays an error indicating the judgment in response to the notification of the notification means 103, and the apparatus is stopped (S211).

Moreover, when the set size of the recording material is set to be smaller than the width of the region b-3, the judging means 102 judges that the temperature is abnormally high for the certain factor in the vicinity of the second end-portion thermistor TH2 of the fixing apparatus (S212). Moreover, the error indicating this judgment is displayed in the display means 104 or 201 in response to the notification by the notification means 103, and the apparatus is stopped (S213).

In a case where in S206, the second end-portion thermistor TH2 detects the temperature which is lower than T2 degrees, the image forming processing is normally performed (S207). When all the printing processing ends, the job ends (S208).

In a case where it is judged in S201 that the end portion of the fixing mechanism section 20A does not have to be cooled, and the blower cooling mechanism section 20B does not operate, the following sequence is performed.

In a case where in S214, the first end-portion thermistor TH1 detects the temperature which is not less than the predetermined value T1, in S221, the set size of the recording material is judged.

Here, when the set size of the recording material in the width direction of the fixing region set by the user is set to be larger than the size of the region b-1, the judging means 102 judges that the size of the actually passed recording material is different from and smaller than the set size of recording material set by the user (S222). That is, the judging means 102 judges that the size of the actually passed recording material does not match the actual size of the recording material. Moreover, the error indicating the judgment is displayed in the display means 104 or 201 in response to the notification by the notification means 103, and the apparatus is stopped (S223).

When in S221, the set size of the recording material is smaller than the width of the region b-1, the judging means 102 judges that the temperature is abnormally high owing to the certain factor in the vicinity of the second end-portion thermistor TH2 of the fixing mechanism section 20A. Moreover, the error indicating the judgment is displayed in the display means 104 or 201 in response to the notification by the notification means 103, and the apparatus is stopped (S225).

In a case where in S214, the first end-portion thermistor TH1 detects the normal temperature which is lower than the predetermined value T1, but in S215, the second end-portion thermistor TH2 detects the temperature which is not less than T2, in S216, the set size of the recording material is judged (S216).

Here, there will be described a case where the size of the recording material in the width direction of the fixing region set by the user is the width size of the region b-3 which is not cooled by the blower cooling mechanism section 20B outside the second end-portion thermistor TH2.

In this case, the judging means 102 judges that the size of the actually passed recording material is different from and smaller than the recording material size set by the user (S217). The judging means 102 judges that the size of the actually passed recording material does not match the actual size of the recording material. Moreover, the display means 104 or 201 displays the error indicating the judgment in response to the notification of the notification means 103, and the apparatus is stopped (S218).

When the set size of the recording material is set to the width smaller than the region b-3, the judging means 102 judges that the temperature is abnormally high owing to the certain factor in the vicinity of the second end-portion thermistor TH2 of the fixing mechanism section 20A (S219). Moreover, the error indicating the judgment is displayed in the display means 104 or 201 in response to the notification by the notification means 103, and the apparatus is stopped (S220).

In a case where in S215, the second end-portion thermistor TH2 detects the temperature which is lower than the predetermined value T2, the image forming processing is normally performed (S207). When all the printing processing ends, the job is ended (S208).

Figures 2, 2A:
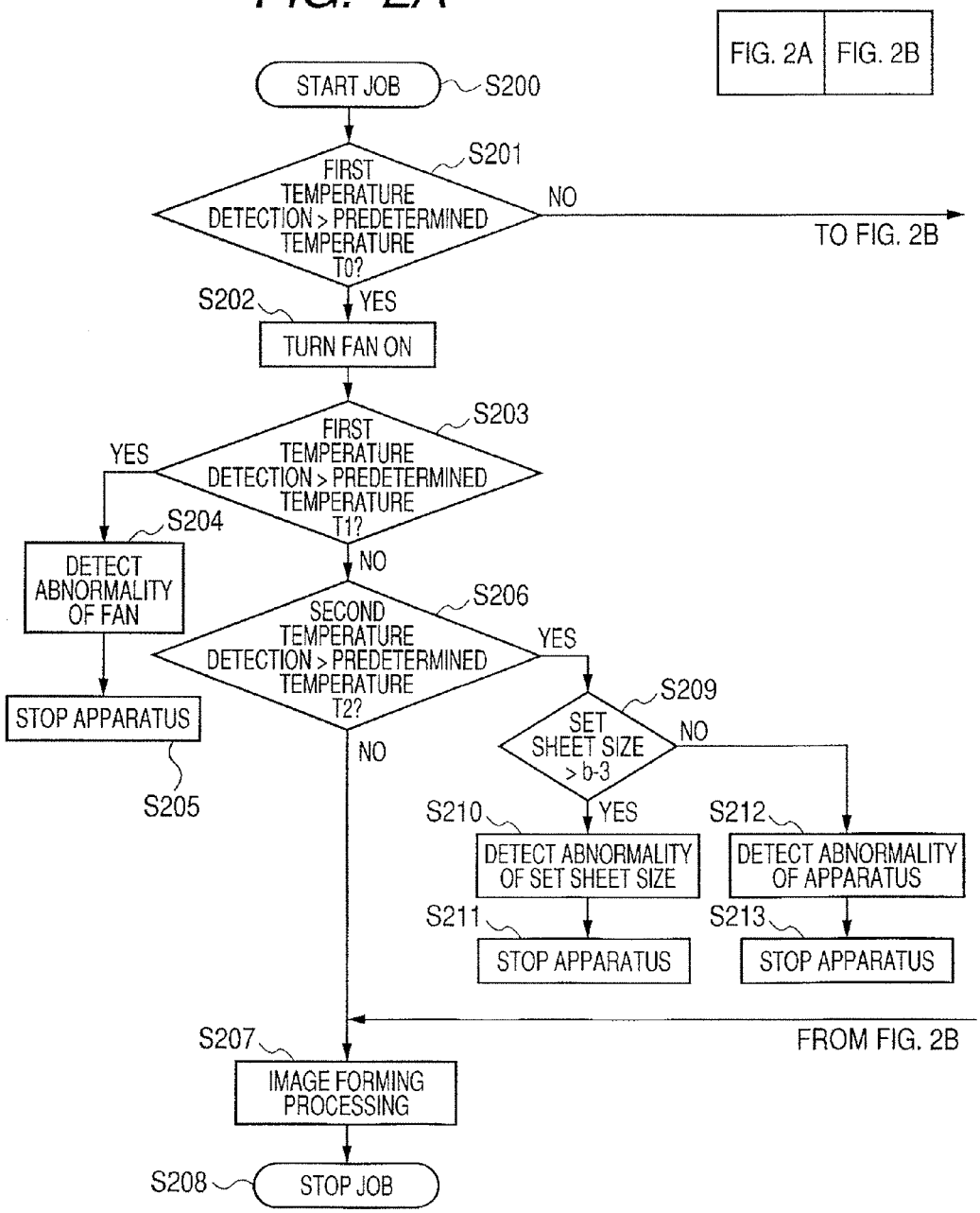
FIG. 2 is comprised of FIGS. 2A and 2B showing a flow chart of a control sequence to judge the abnormal state of the apparatus.

Thus, in the control sequence of FIG. 2, the first or second end-portion thermistor TH1 or TH2 detects the abnormally high temperature, it is judged that the recording material having the size different from the recording material size set by the user has been passed, user's attention is called, and the apparatus is stopped.

Figures 3, 3A:
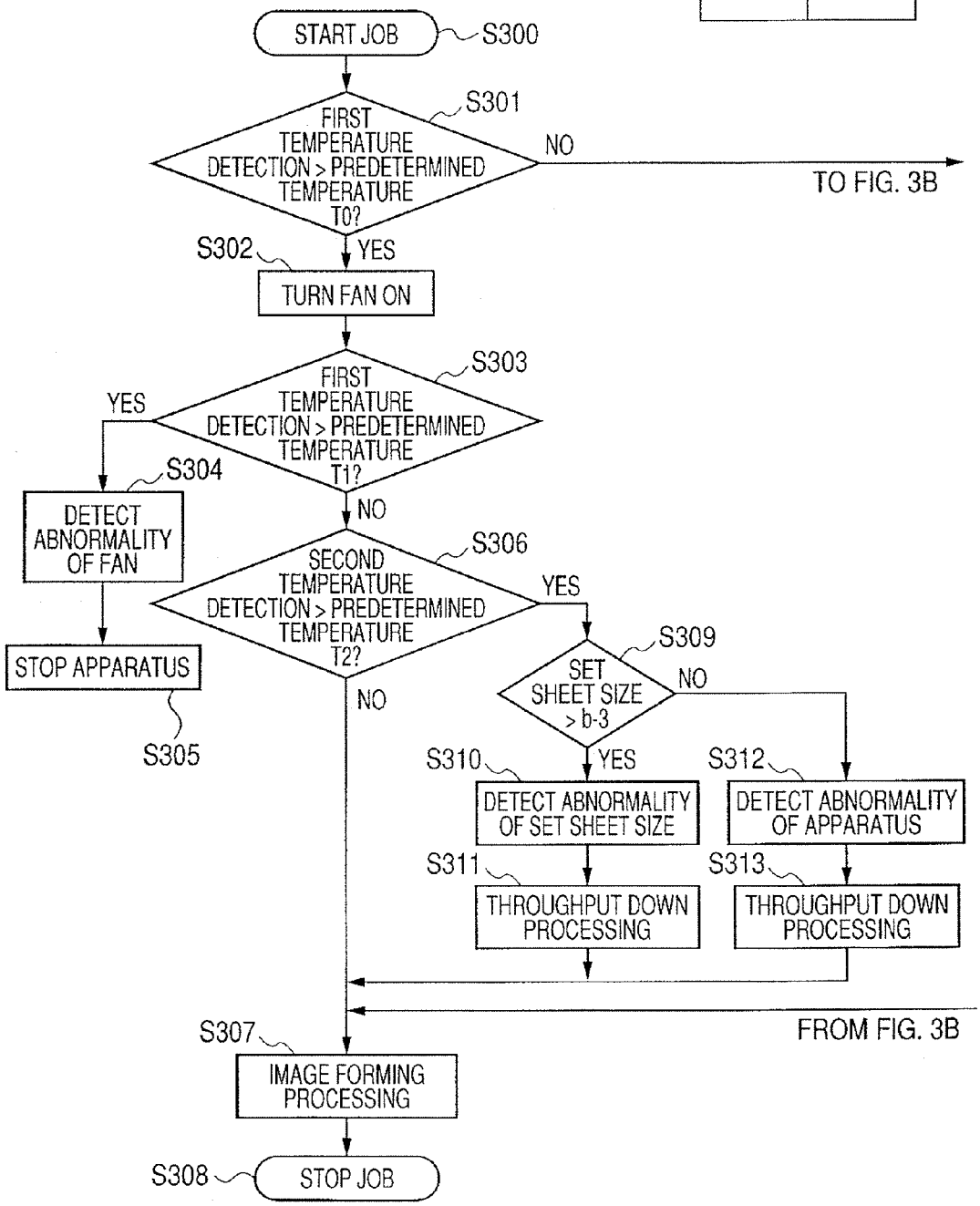
FIG. 3 is comprised of FIGS. 3A and 3B showing a flow chart of a control sequence to judge the abnormal state of the apparatus.
Figure 3B:
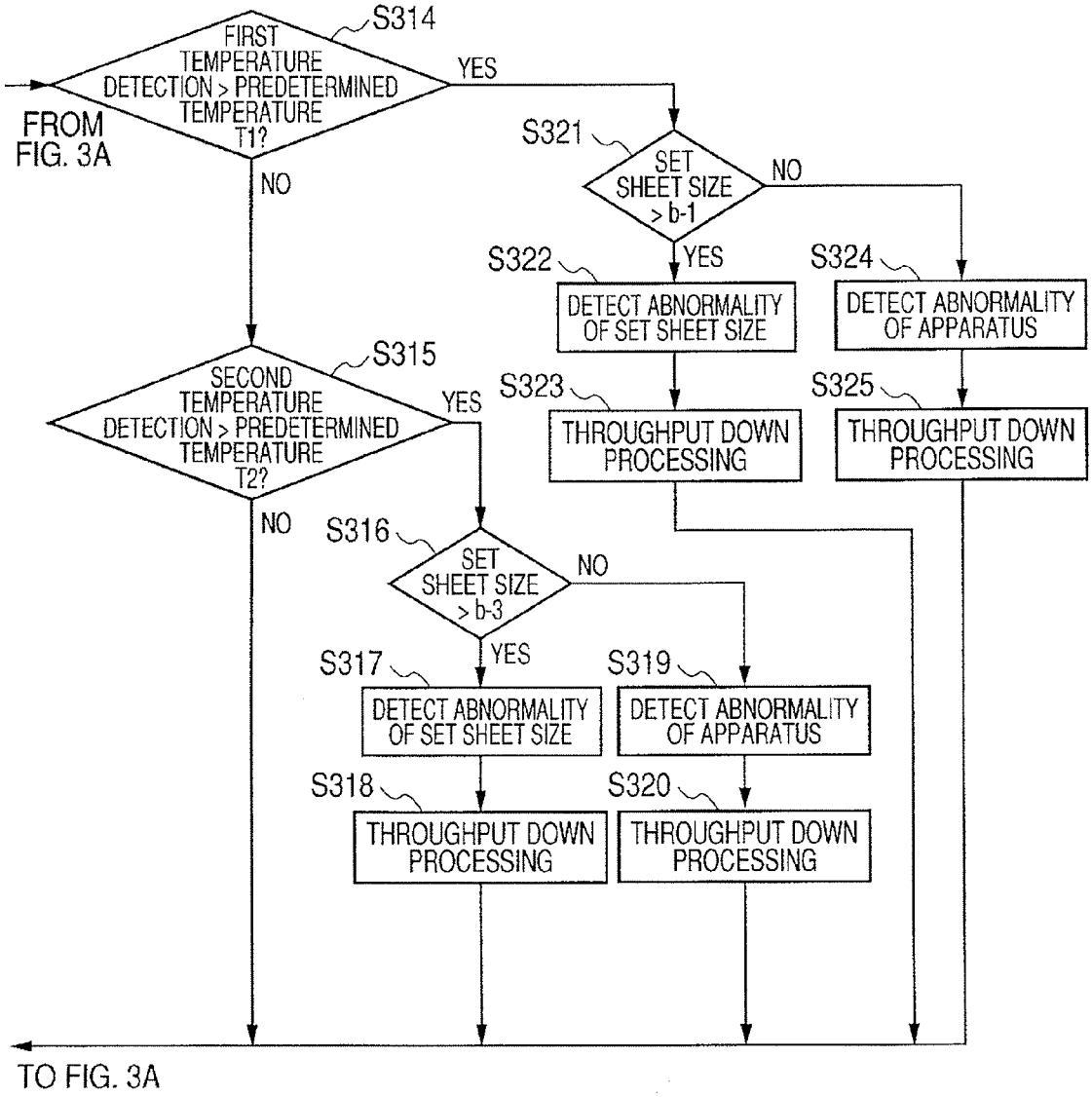

(3-3) Next, there will be described a sequence in which the image forming processing is continued without stopping the apparatus in a case where abnormality of the recording material size is detected with reference to a flow chart of FIGS. 3A and 3B.

Figure 2B:
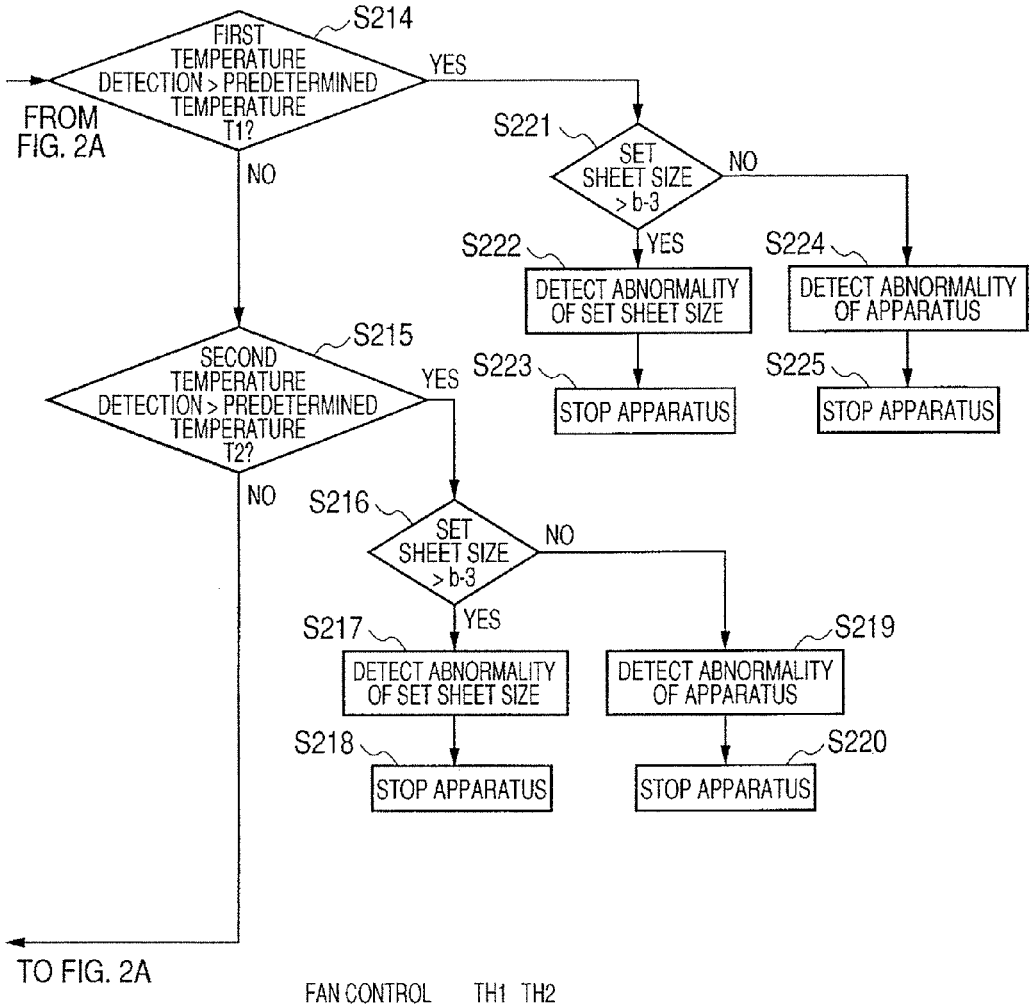

First, it is assumed that the user sets the recording material size in the same manner as in FIGS. 2A and 2B. The user sets the recording material size as follows. That is, the size in the width direction of the fixing region is set to the maximum size between the regions b-2 described above. Alternatively, the size in the width direction of the fixing region may be set to the width size of the region b-3 which is not cooled by the blower cooling mechanism section 20B, outside the second end-portion thermistor TH2.

Moreover, the control circuit section 100 issues a print job start signal (S300).

Next, during the printing, in a case where in S301, the first end-portion thermistor TH1 detects the temperature which is T0 degrees or more, the fans 41 are operated to blow the cooling air for cooling the end portions of the fixing mechanism section 20A (S302).

Next, in a case where in 303, the first end-portion thermistor TH1 detects the temperature which not less than the predetermined value of T1 degrees, the judging means 102 judges that the fans 41 do not normally operate (S304). Moreover, the error indicating the judgment is displayed in the display means 104 or 201 in response to the notification by the notification means 103, and the apparatus is stopped (S305).

In a case where in S303, the temperature detected by the first end-portion thermistor TH1 is lower than T1 degrees but in S306, the second end-portion thermistor TH2 detects T2 degrees or more, in S309, the set size of the recording material is judged.

Here, there will be described a case where the size of the recording material in the width direction of the fixing region is set, by the user, to a width size in the region b-3 which is not cooled by the blower device, outside the second end-portion thermistor TH2.

In this case, the judging means 102 judges that there has actually been passed the recording material having the recording material width size smaller than the set recording material width size (S310). The display means 104 or 201 displays that the recording material size is abnormal in response to the notification of the notification means 103. Throughput down processing is performed to set a sheet passing interval to be longer than usual and prevent the abnormally high temperature of the fixing mechanism section 20A (S311), and the image forming processing is continued (S307).

When the set size of the recording material is set to be smaller than the width of the region b-3, the judging means 102 judges that the temperature is abnormally high for the certain factor in the vicinity of the second end-portion thermistor TH2 of the fixing mechanism section 20A (S312). Moreover, the display means 104 or 201 displays that the apparatus is abnormal in response to the notification by the notification means 103. In addition, the throughput down processing is performed to set the sheet passing interval to be longer than usual and prevent the abnormally high temperature of the fixing apparatus (S313), and the image forming processing is continued (S307).

In a case where it is judged in S301 that the end portion of the fixing mechanism section 20A does not have to be cooled, and the blower cooling mechanism section 20B does not operate, the following sequence is performed.

In a case where in S314, the first end-portion thermistor TH1 detects the temperature which is not less than the predetermined value T1, in S321, the set size of the recording material is judged.

Here, there will be described a case where the size of the recording material in the width direction of the fixing region set by the user is set to be larger than the size of the region b-1. In this case, the judging means 102 judges that the size of the actually passed recording material is different from and smaller than the recording material size set by the user (S322). That is, the judging means 102 judges that the size of the actually passed recording material does not match the actual size of the recording material. Moreover, the display means 104 or 201 displays that the recording material size is abnormal in response to the notification by the notification means 103. In addition, the throughput down processing is performed to set the sheet passing interval to be longer than usual and prevent the abnormally high temperature of the fixing apparatus (S323), and the image forming processing is continued (S307).

When in S321, the set size of the recording material is smaller than the width of the region b-1, the judging means 102 judges that the temperature is abnormally high owing to the certain factor in the vicinity of the first end-portion thermistor TH1 of the fixing mechanism section 20A (S324). Moreover, the display means 104 or 201 displays that the apparatus is abnormal in response to the notification by the notification means 103. In addition, the throughput down processing is performed to set the sheet passing interval to be longer than usual and prevent the abnormally high temperature of the fixing mechanism section 20A (S325), and the image forming processing is continued (S307).

In a case where in S314, the first end-portion thermistor TH1 normally detects the temperature which is lower than the predetermined value T1, but in S315, the second end-portion thermistor TH2 detects T2 or more, in S316, the set size of the recording material is judged.

Here, there will be described a case where the size of the recording material in the width direction of the fixing region set by the user is the width size of the region b-3 which is not cooled by the blower cooling mechanism section 20B, outside the second end-portion thermistor TH2.

In this case, the judging means 102 judges that the size of the actually passed recording material is different from and smaller than the recording material size set by the user (S317). That is, the judging means 102 judges that the size of the actually passed recording material does not match the actual size of the recording material. Moreover, the display means 104 or 201 displays that the recording material size is abnormal in response to the notification of the notification means 103. In addition, the throughput down processing is performed to set the sheet passing interval to be longer than usual and prevent the abnormally high temperature of the fixing apparatus (S318), and the image forming processing is continued (S307).

When the set size of the recording material is set to the width smaller than the region b-3, the judging means 102 judges that the temperature is abnormally high owing to the certain factor in the vicinity of the second end-portion thermistor TH2 of the fixing mechanism section 20A (S319). Moreover, the display means 104 or 201 displays that the recording material size is abnormal in response to the notification by the notification means 103. In addition, the throughput down processing is performed to set the sheet passing interval to be longer than usual and prevent the abnormally high temperature of the fixing apparatus (S320), and the image forming processing is continued (S307).

In a case where in S315, the second end-portion thermistor TH2 detects the temperature which is lower than the predetermined temperature T2, the image forming processing is normally performed (S307). When all the printing processing ends, the job is ended (S308).

After the end of the job, in a case where the size of the passed recording material is different from the set size, and therefore the throughput down processing is performed, in response to the notification by the notification means 103, the display means 104 or 201 notifies the user of this effect.

Moreover, in a case where the throughput down processing is performed owing to the apparatus abnormality, in response to the notification by the notification means 103, the display means 104 or 201 notifies the user that the certain abnormality is generated in the apparatus, and control is executed so as to prevent the next job from being started.

Thus, when the throughput down processing is performed to set the sheet interval to be long, non-stop of the apparatus is realized as long as possible.

Furthermore, in the above-described control, when it is judged that the operation of the cooling means is abnormal, the image forming is discontinued, and the subsequent image forming is prohibited. Moreover, when it is judged that the set recording material width is abnormal, the throughput down processing is performed. That is, the control is executed to reduce the number of the recording materials to be passed through the fixing nip portion per unit time so that the image forming is continued.

In addition, in the above control, when it is judged that the operation of the cooling means is abnormal, the image forming is discontinued, and the subsequent image forming is prohibited. Moreover, when it is judged that the set recording material width is abnormal, the control may be executed to discontinue the image forming so that the image forming is made possible after resetting the recording material width.

It is to be noted that in the above-described flow charts of FIGS. 1 to 3A and 3B, the predetermined temperatures T0, T1 and T2 are specifically, for example, the predetermined temperature T0: 95 degrees (constant speed, plain paper), the predetermined temperature T1: 250 degrees and the predetermined temperature T2: 250 degrees, respectively. However, the predetermined temperature T0 differs with speed and material, and ranges from about 170 degrees to about 210 degrees. A conditioned fixing temperature is about 230 degrees at the constant speed with the plain paper.

Figure 14:
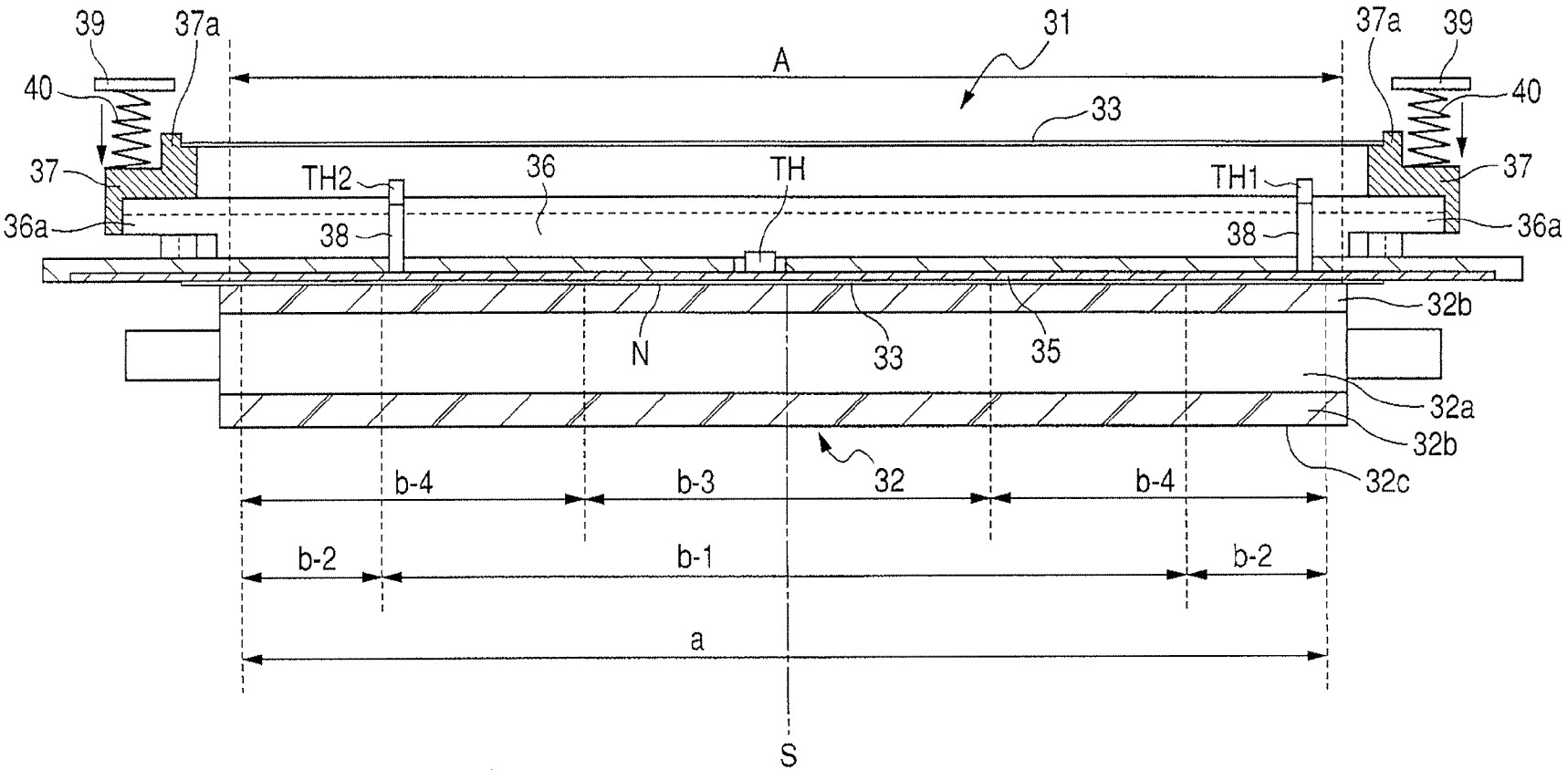
FIG. 14 is a diagram showing another arrangement example of first and second end-portion thermistors TH1 and TH2.

The first and second end-portion thermistors TH1 and TH2 may be arranged in a relation shown in FIG. 14. That is, in FIG. 7, the first and second end-portion thermistors TH1 and TH2 are arranged on the same side of the main thermistor TH, but as shown in FIG. 14, the first and second end-portion thermistors TH1 and TH2 may be disposed on opposite sides of the main thermistor TH. That is, the second end-portion thermistor TH2 may be positioned at a distance from the main thermistor TH, which is shorter than that of the first end-portion thermistor TH1 from the main thermistor, and disposed so as to detect the temperature of the film 33.

As described above, it is possible to detect the abnormality of the apparatus by use of the blower cooling mechanism 20B (cooling means), the first end-portion thermistor TH1 and the second end-portion thermistor TH2.

Moreover, depending on a detection situation, the sheet passing interval is set to be long, and the abnormally high temperature of the apparatus is avoided, whereby it is possible to execute such a control as to prevent the apparatus from being stopped as long as possible.

It has been described that the image heating member is of a thin roller type, but the present invention is not especially limited to this example, and a similar effect is obtained even with a belt type image heating member.

The image heating means 20A is not limited to the heating apparatus of the film heating system in the embodiment, and a heating apparatus of a heat roller system or a heating apparatus including another constitution may be used. An apparatus of an electromagnetic induction heating system may be constituted.

Moreover, the image heating means 20A may obtain a similar effect even in a constitution in which the recording material is passed on the basis of one-sided conveyance.

With respect to the blower ports 43 of the blower cooling mechanism section 20B, the shutters 44 and the shutter driving device 45 of the shutters may be omitted.

Furthermore, the image heating apparatus may be applied to not only the above-described fixing apparatus but also a luster increasing apparatus which increases luster of the image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-265878, filed Sep. 13, 2005, which is hereby incorporated by reference herein in its entirety.

What is claimed is:

1. An image forming apparatus comprising:

an image forming device that forms an image on a recording material in accordance with a set width of the recording material;

an image heating member which heats the image on the recording material at a nip portion;

a first detecting member which detects a temperature of a first region of the image heating member, the first region corresponding to an outside region of a contact region in a width direction, the contact region being contactable with a recording material having the set width;

a cooling portion that cools the first region of the image heating member in accordance with the output of the first detecting member;

a second detecting member which detects a temperature of a second region of said image heating member, the second region corresponding to an inside region of the contact region in the width direction; and a notification portion that notifies of an abnormality in accordance with an output of the first detecting member and an output of the second detecting member, wherein said notification portion that notifies that the set width of the recording material does not match an actual width in a case where the detected temperature of said first detecting member is a normal temperature and the detected temperature of said second detecting member is an abnormal temperature, and the notification portion notifies that the cooling portion is abnormal in a case where the detected temperature of said second detecting member is a normal temperature and the detected temperature of said first detecting member is an abnormal temperature.

2. An image forming apparatus according to claim 1, when a detecting temperature of said first detecting member is normal and a detecting temperature of said second detecting member is abnormal, image formation is halted.

3. An image forming apparatus according to claim 1, when a detecting temperature of said first detecting member is abnormal and a detecting temperature of said second detecting member is normal, image formation is halted.

* * * * *